US009335734B2

(12) United States Patent
Nagamori et al.

(10) Patent No.: US 9,335,734 B2
(45) Date of Patent: May 10, 2016

(54) SUCTION PIPE WITH FLOW CONTROL MEMBERS

(71) Applicant: FUJI XEROX CO., LTD., Tokyo (JP)

(72) Inventors: Yuki Nagamori, Kanagawa (JP); Yasunori Momomura, Kanagawa (JP); Masafumi Kudo, Kanagawa (JP); Kazuki Inami, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/444,371

(22) Filed: Jul. 28, 2014

(65) Prior Publication Data

US 2015/0110518 A1 Apr. 23, 2015

(30) Foreign Application Priority Data

Oct. 21, 2013 (JP) ..... 2013-218201
Mar. 25, 2014 (JP) ..... 2014-061708

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 2221/1645; F24F 7/00; F24F 2007/001
USPC ..... 399/92
See application file for complete search history.

(56) References Cited

U.S. PATENT DOCUMENTS 3,969,785 A * 7/1976 Ogawa et al. ..... 15/301
4,178,092 A * 12/1979 Yamamoto et al. ..... 399/93
2007/0071484 A1* 3/2007 Igarashi ..... G03G 21/206 399/92
2012/0213545 A1* 8/2012 Ohno ..... G03G 15/0189 399/92

FOREIGN PATENT DOCUMENTS

JP A-10-20723 1/1998

* cited by examiner

*Primary Examiner* — Billy Lactaoen
(74) *Attorney, Agent, or Firm* — Oliff PLC

(57) ABSTRACT

Provided is a suction pipe including a suction port that has an opening shape which is long in one direction parallel with a longitudinal-direction part of an object structure long in one direction, and is arranged to face the longitudinal-direction part of the object structure to suction the air, an exhaust port that has an opening shape which is different shape from the opening shape of the suction port, and suctions out the air suctioned from the suction port, a flow path that connects the suction port and the exhaust port and has at least one bended portion which bends an air flow direction, and at least one flow control members that are disposed at flow path in one direction parallel with the suction port, and controls a flow of the air.

12 Claims, 27 Drawing Sheets

FIG. 19

| SAMPLE No. | CONDITION OF FLOW CONTROL MEMBER (VENTILATION PORTION) | | WIND VOLUME AT THE TIME OF SUCTION ($m^3$/min) |
|---|---|---|---|
| | LENGTH OF PATH $Sm_2$ (mm) | HEIGHT $Sh_2$ (mm) | |
| 1 | 7 | 1.5 | 0.1 |
| 2 | 7 | 1.5 | 0.3 |
| 3 | 9 | 1.5 | 0.1 |
| 4 | 9 | 1.5 | 0.3 |
| 5 | 7 | 3 | 0.1 |
| 6 | 7 | 3 | 0.3 |
| 7 | 9 | 3 | 0.1 |
| 8 | 9 | 3 | 0.3 |
| 9 | 7 | 4 | 0.3 |
| 10 | 7 | 5 | 0.3 |
| 11 | 7 | 6 | 0.3 |

SUCTION PIPE WITH FLOW CONTROL MEMBERS

CROSS-REFERENCE TO RELATED APPLICATIONS

This application is based on and claims priority under 35 USC 119 from Japanese Patent Application No. 2013-218201 filed Oct. 21, 2013 and Japanese Patent Application No. 2014-061708 filed Mar. 25, 2014.

BACKGROUND

Technical Field

The present invention relates to a suction pipe, a suction device, and an image forming apparatus.

SUMMARY

According to an aspect of the invention, there is provided a suction pipe including:

a suction port that has an opening shape which is long in one direction parallel with a longitudinal-direction part of an object structure long in one direction, and is arranged to face the longitudinal-direction part of the object structure to suction the air;

an exhaust port that has an opening shape which is different shape from the opening shape of the suction port, and suctions out the air suctioned from the suction port;

a flow path that connects the suction port and the exhaust port and has at least one bended portion which bends an air flow direction; and at least one flow control members that are disposed at flow path in one direction parallel with the suction port, and controls a flow of the air.

BRIEF DESCRIPTION OF THE DRAWINGS

Exemplary embodiments of the present invention will be described in detail based on the following figures, wherein:

FIGS. 13A and 13B are views illustrating an example of a suction duct as a comparative example, in which FIG. 13A is a perspective view illustrating the suction duct, and FIG. 13B is a cross-sectional view taken along line Q-Q of FIG. 13A;

FIG. 19 is a table illustrating conditions in sample A relating to the suction duct;

DETAILED DESCRIPTION

Hereinafter, exemplary embodiments of the invention (simply referred to as "exemplary embodiments") will be described with reference to the accompanying drawings.

(First Exemplary Embodiment)

Figure 1:
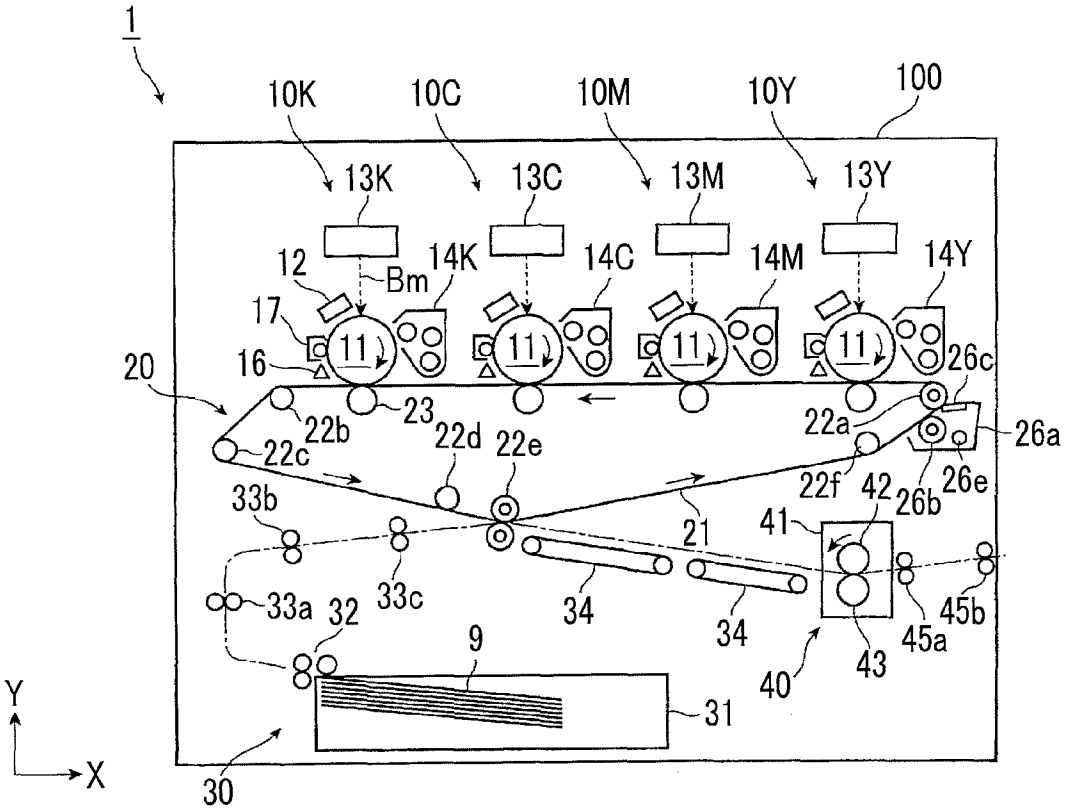
FIG. 1 is an explanatory view illustrating an overview of an image forming apparatus that uses a suction device (having a suction duct) according to a first exemplary embodiment.
Figure 3A:
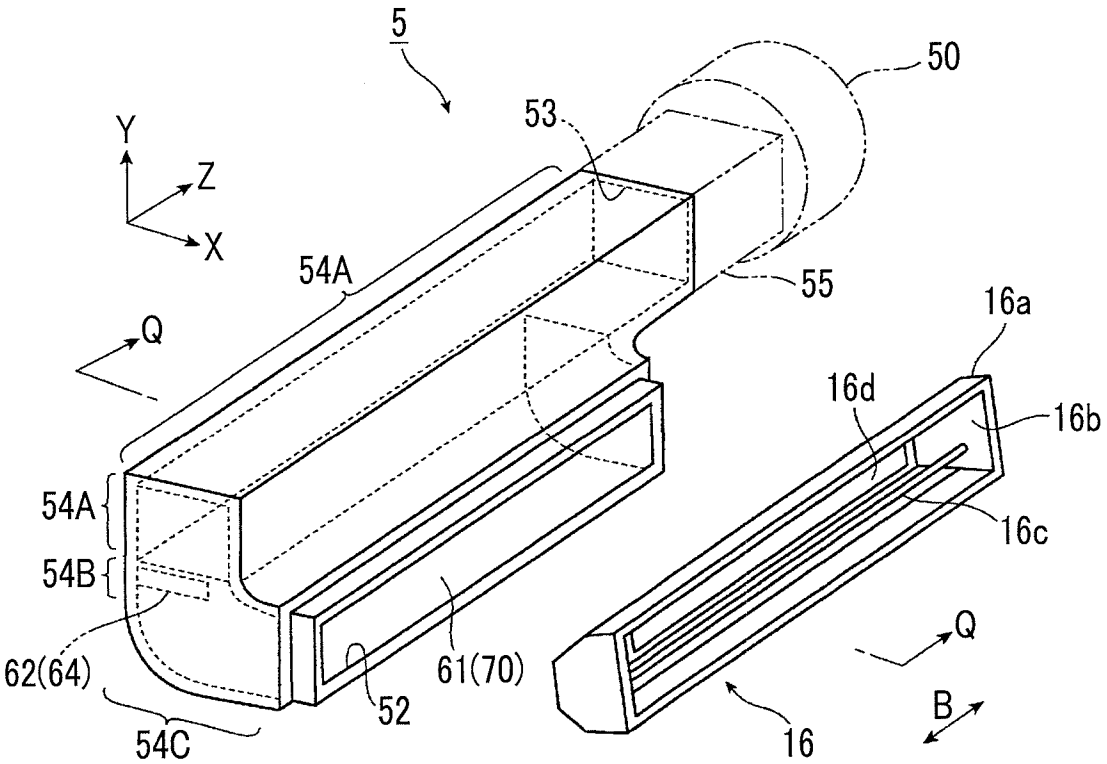
FIGS. 3A and 3B are perspective views illustrating an overview of the suction device with which the image forming apparatus of FIG. 1 is equipped and a pre-transfer corona discharger of a structure that is a suction object thereof.
Figure 3B:
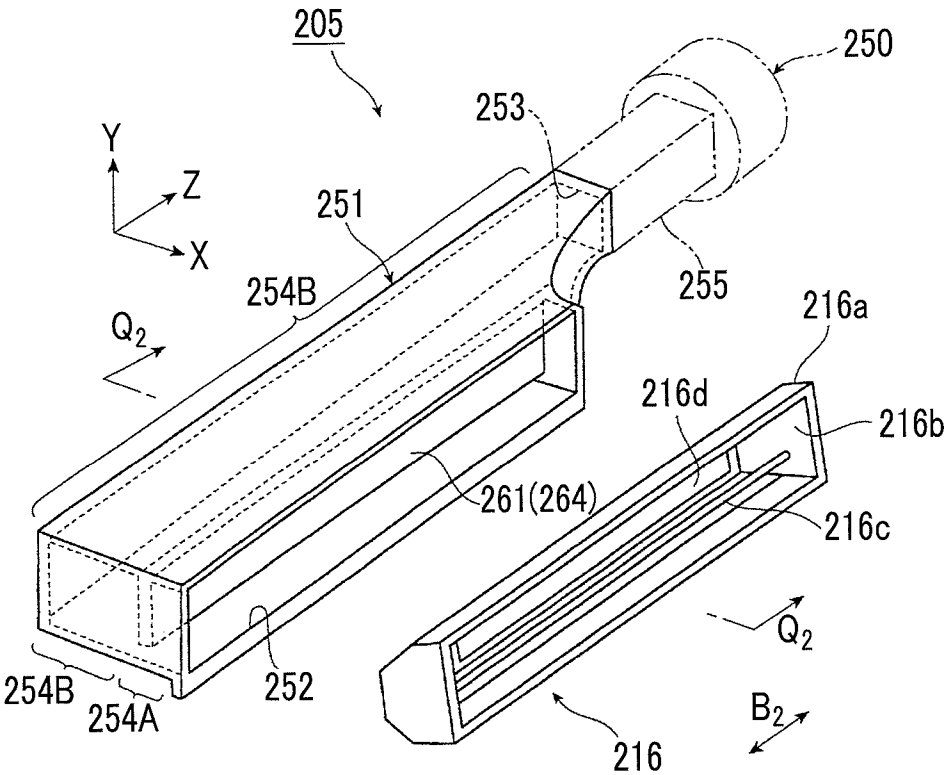
Figure 4A:
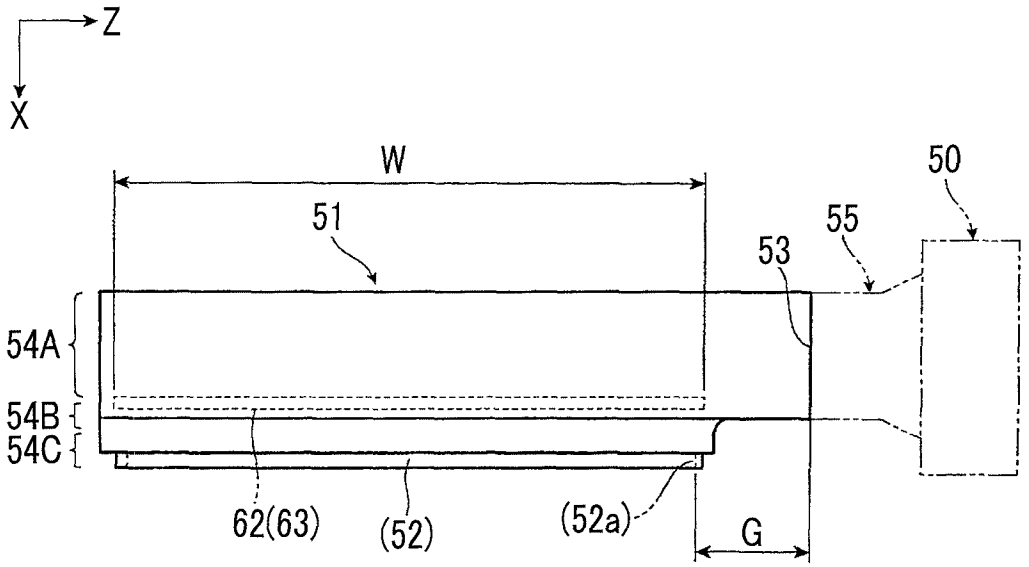
FIGS. 4A and 4B are schematic views illustrating a state where the suction device of FIGS. 3A and 3B is viewed from above.
Figure 4B:
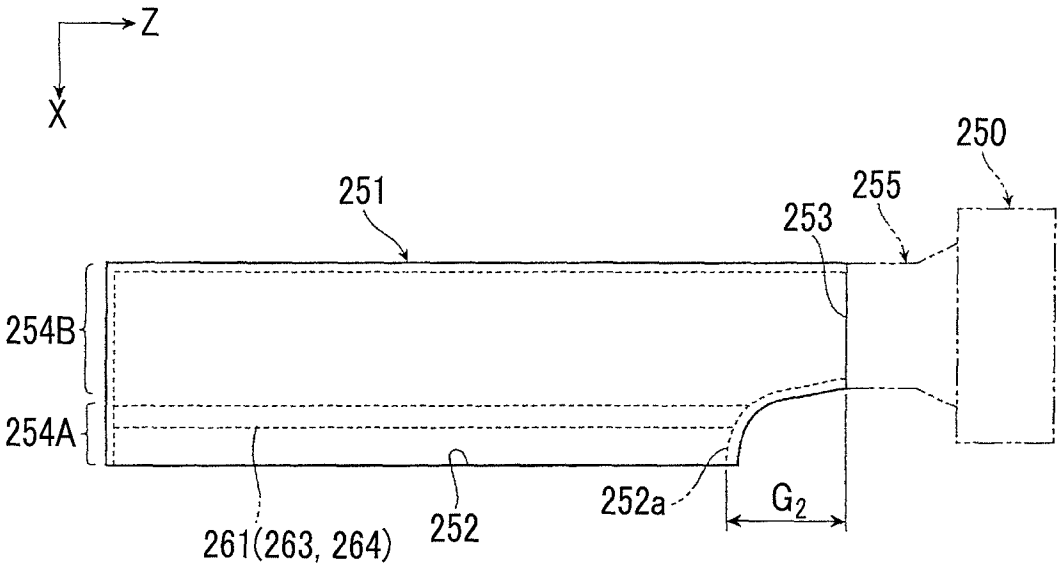
Figure 5:
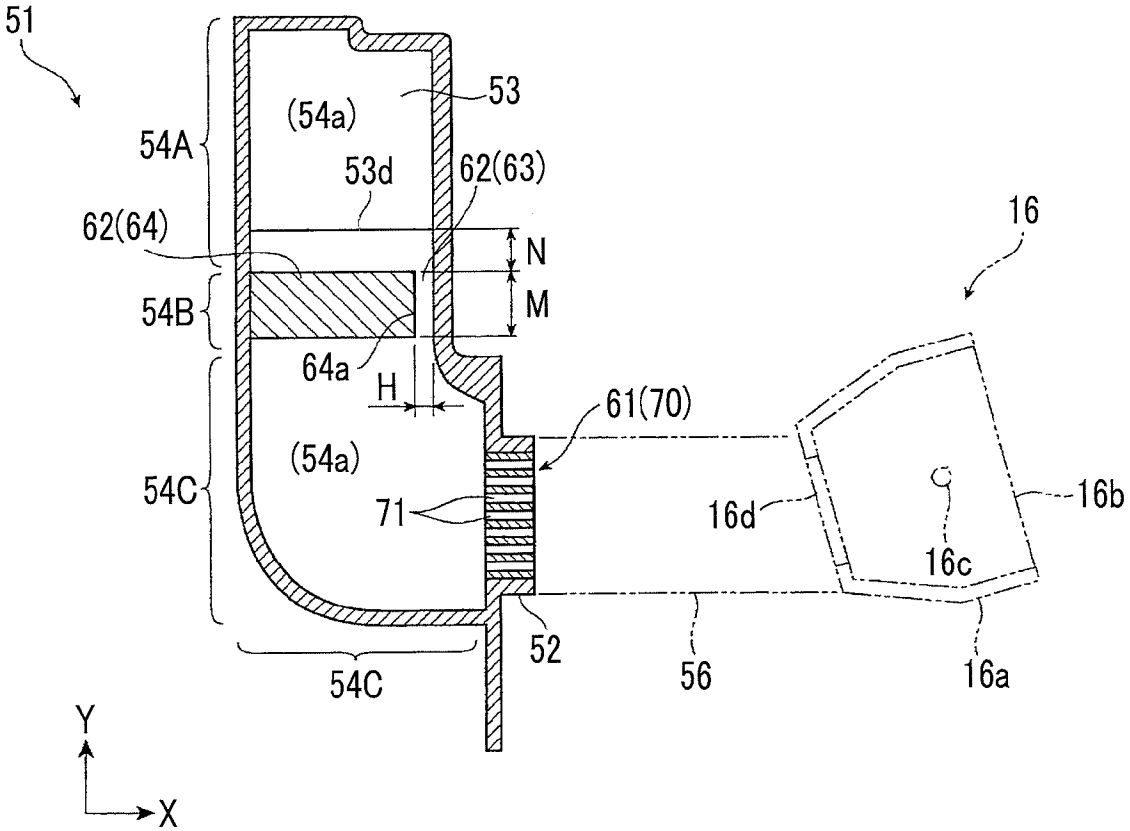
FIG. 5 is a cross-sectional explanatory view of the suction device (suction duct) and the pre-transfer corona discharger of FIGS. 3A and 3B taken along line Q-Q.
Figure 6:
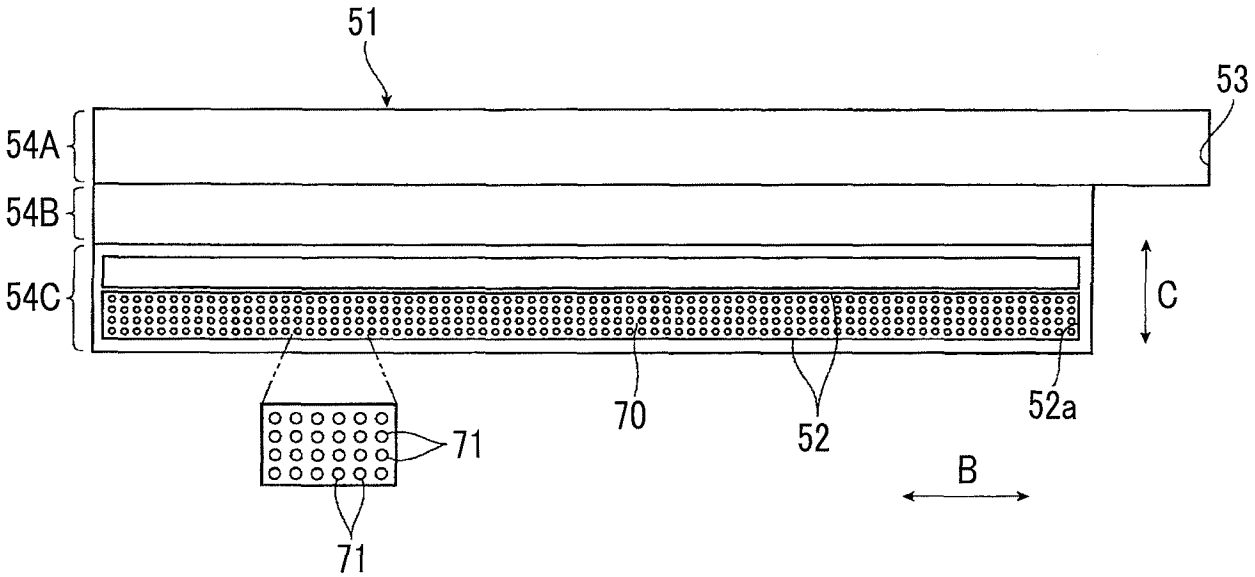
FIG. 6 is a schematic view illustrating a state where the suction duct of the suction device of FIGS. 3A and 3B is viewed from a suction port side.

FIGS. 1 to 6 are views illustrating a suction pipe according to a first exemplary embodiment and a suction device and an image forming apparatus that use the suction pipe. FIG. 1 illustrates an overview of the image forming apparatus. FIGS. 2A and 2B illustrate a main part (such as an imaging unit having the suction device) of the image forming apparatus. FIGS. 3A and 3B illustrate the suction device (having the suction pipe) and a corona discharger, which is an example of a long object structure that requires suction of air by the suction device. FIGS. 4A and 4B illustrate a state where the suction device of FIGS. 3A and 3B is viewed from above. FIG. 5 illustrates a cross-sectional state of the suction device (the suction pipe and the corona discharger) of FIGS. 3A and 3B along line Q-Q. FIG. 6 illustrates a state where mainly a suction port of the suction pipe of the suction device of FIGS. 3A and 3B is viewed. Arrows that are illustrated with signs X, Y, and Z in the drawings are (directions of) orthogonal coordinate axes respectively illustrating a width direction, a height direction, and a depth direction of a three-dimensional space assumed in each of the drawings.

An image forming apparatus 1 according to the first exemplary embodiment is configured, for example, as a color printer. As illustrated in FIG. 1, a support frame, imaging units 10 that form toner images, which are formed of toner as a developer, in a housing 100 configured to have an exterior cover and the like, an intermediate image transfer unit 20 that holds the toner images formed by the imaging units 10 through primary image transfer and then secondary image-transfers the toner images to recording sheets 9 as a recording target material, a sheet feeding device 30 that accommodates, transports, and feeds the required recording sheets 9 which should be supplied to a secondary image transfer position of the intermediate image transfer unit 20, a fixing device 40 that fixes the toner images onto the recording sheets 9 where the toner images are transferred by the intermediate image transfer unit 20, and the like are arranged in the image forming apparatus 1. The one-dot chain line in FIG. 1 illustrates a main transporting path of the recording sheets 9.

The imaging units 10 are configured as four imaging units 10Y, 10M, 10C, and 10K that are dedicated to form the toner images of the four respective colors of yellow (Y), magenta (M), cyan (C), and black (K). The four imaging units 10 (Y, M, C, and K) are arranged in a serially aligned state in an internal space of the housing 100. The respective imaging units 10 (Y, M, C, and K) have a configuration substantially common to one another as described below.

Figure 2A:
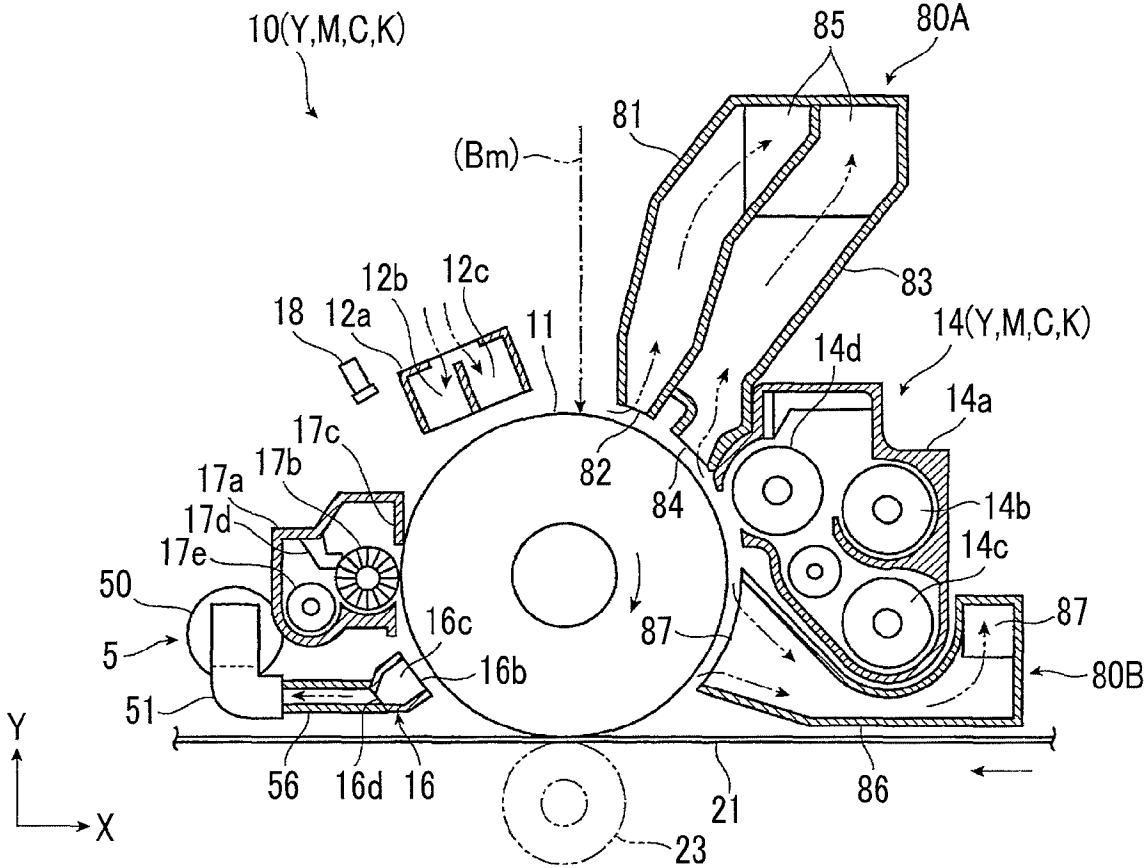
FIGS. 2A and 2B are perspective views illustrating a main part (such as an imaging unit to which the suction device is applied) of the image forming apparatus of FIG. 1.
Figure 2B:
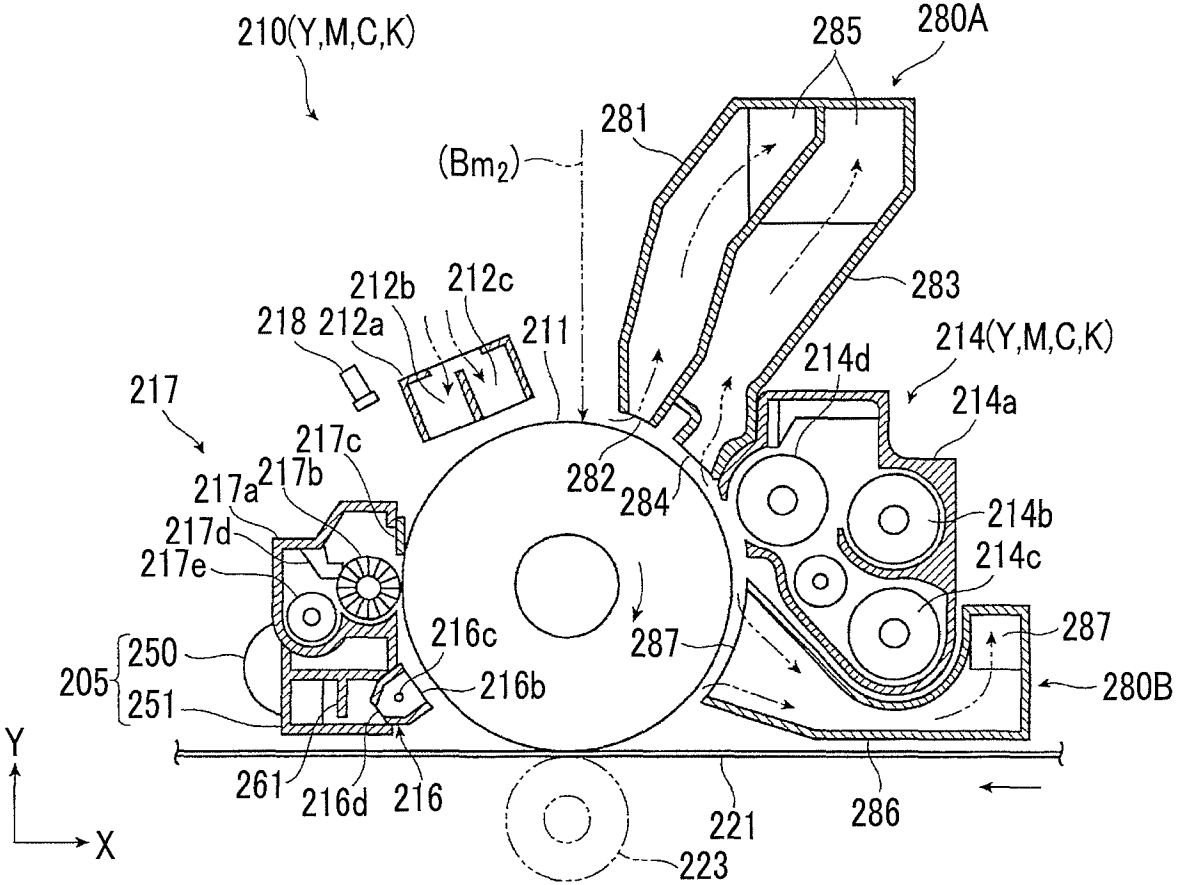

Each of the imaging units 10 (Y, M, C, and K) is configured by using, for example, known electrophotography, and has a photoconductive drum 11 that rotates in a direction illustrated with the arrow (clockwise direction in the drawing) as illustrated in FIGS. 1, 2A, and 2B. Mainly the respective following devices are arranged in the vicinity of the photoconductive drums 11.

The main devices are charging devices 12 that charge image holding surfaces (outer circumferential surfaces) of the photoconductive drums 11, where the images may be formed, with a required potential, exposure devices 13 (Y, M, C, and K) that form electrostatic latent images (of the respective colors) with potential differences by irradiating the charged outer circumferential surfaces of the photoconductive drums 11 with light based on image information (signal), developing devices 14 (Y, M, C, and K) that turn the electrostatic latent images into the toner images, which are visible images, by developing the electrostatic latent images with the toner as the developers for the corresponding colors (Y, M, C, and K), charge adjusting corona dischargers 16 that primary image-transfer the toner images to (an intermediate image transfer belt of) the intermediate image transfer unit 20 and then adjust the charged states with adhered materials such as the toner, which remain to adhere to the image holding surfaces of the photoconductive drums 11, included, drum cleaning devices 17 that remove the adhered materials such as the toner, which pass through the charge adjusting corona dischargers 16 and adhere to the image holding surfaces of the photoconductive drums 11 to clean the surface, charge removers 18 that erase the image holding surfaces of the photoconductive drums 11 after the cleaning, and the like.

In the photoconductive drum 11, the image holding surface that has a photoconductive layer (photosensitive layer) formed of a photosensitive material is formed on a circumferential surface of a cylindrical or columnar base material which is grounded. The photoconductive drum 11 rotates in the direction illustrated with the arrow in response to power from a rotation driving device (not illustrated). The charging device 12 is a non-contact type charging device that applies charging bias to a discharge wire, which is arranged at required gaps on the image holding surface of the photoconductive drum 11, to charge the wire through corona discharge. A so-called scorotron type corona discharger, in which two discharge wires 12*b* and 12*c* are stretched in a container type shield case (covering member) 12*a* that is long along an axial direction of the photoconductive drum 11 and a charge adjusting material is arranged in an opening portion of the shield case 12*a* that faces the photoconductive drum 11, is used as the charging device 12 according to the first exemplary embodiment. A voltage or a current that has the same polarity as a charge polarity of the toner which is supplied from the developing device is supplied as the charging bias when the developing device 14 is a developing device that performs reversal development.

The exposure devices 13 (Y, M, C, and K) form the electrostatic latent images by irradiating the charged image holding surfaces of the photoconductive drums 11 with light beams Bm (dotted lines with the arrows) that are configured according to the image information input into the image forming apparatus 1. A non-scanning type exposure device that is configured by using a light-emitting diode, an optical component, and the like, and a scanning type exposure device that is configured by using an optical component such as semiconductor laser and a polygon mirror are used as the exposure device 13. The developing devices 14 (Y, M, C, and K) use a two-component developer that contains the toner, a carrier, and the like. As illustrated in FIGS. 2A and 2B, the developing devices 14 (Y, M, C, and K) stir the two-component developer for any one of the four colors accommodated in a container-shaped housing 14*a* with stirring transport members 14*b* and 14*c* such as a screw auger to triboelectric-charge the two-component developer with the required polarity and then cause the two-component developer to be held by a developing roller 14*d* rotating with developing bias supplied, supply the two-component developer to a development area facing the photoconductive drum 11, and develop the latent images formed on the photoconductive drums 11.

As illustrated in FIGS. 2A, 2B, 3A, 3B, and the like, the container-shaped charge adjusting corona discharger 16 is long along the axial direction of the photoconductive drum 11, and is configured mainly by a shield case (covering member) 16*a* where a site facing the photoconductive drum 11 is shaped to be an opening (16*b*) in an elongated oblong shape, and a discharge wire 16*c* that is stretched to be substantially parallel to the axial direction of the photoconductive drum 11 in an internal space of the shield case 16*a*. An elongated oblong opening 16*d* that is substantially parallel to the axial direction of the photoconductive drum 11 (corresponding to a longitudinal direction B which is long in one direction) is formed on an end portion surface on the side opposite to the site of the shield case 16*a* facing the photoconductive drum 11. The opening 16*d* is used when the suction of the air is performed by a suction device 5. Charge adjusting bias is supplied to the discharge wire 16*c* during the image formation or the like. In addition, the charge adjusting corona discharger 16 may also be used as a second charging device, along with the charging device 12, to charge the image holding surface of the photoconductive drum 11.

The drum cleaning device 17 is configured to have a container-shaped housing 17*a*, a rotating brush 17*b* that rotates in a state where hair material is in contact with the outer circumferential surface of the photoconductive drum 11 after the primary image transfer, a cleaning plate 17*c* that is arranged to come into contact, at a required pressure, with a position on a further downstream side in the rotation direction than a contact portion of the rotating brush 17*b* on the outer circumferential surface of the photoconductive drum 11 to scrape the adhered material such as the toner that remains to adhere, a flicker 17*d* that scrapes off the adhered material such as the toner that adheres to the hair material of the rotating brush 17*b*, a recovery transport member 17*e* such as a screw auger that recovers the toner or the like which is scraped off from the hair material of the rotating brush 17*b* and transports the toner or the like to a recovery system (not illustrated). A plate-shaped member formed of flexible rubber, a resin, or the like is used as the cleaning plate 17*c*.

As illustrated in FIG. 1 and the like, the intermediate image transfer unit 20 is arranged to be present at a lower position than the respective imaging units 10 (Y, M, C, and K). The intermediate image transfer unit 20 is configured to mainly have an intermediate image transfer belt 21 that rotates (circularly moves) in the direction illustrated with the arrow while passing through sites that are primary image transfer positions of the photoconductive drums 11 (sites until reaching the charge adjusting corona dischargers 16 after passing through the developing devices 14), plural support rollers 22*a* to 22*d* that support the intermediate image transfer belt 21 in a rotatable manner by holding the intermediate image transfer belt 21 in a desired state from an inner surface thereof, primary image transfer devices 23 that primary image-transfer the toner images onto the intermediate image transfer belt 21 while rotating with the intermediate image transfer belt 21 pressed against the site that is the primary image transfer position of the photoconductive drum 11 of each of the imaging units 10, a secondary image transfer device 25 that rotates in contact, at a predetermined pressure, with an outer surface (image holding surface) of the intermediate image transfer belt 21 which is supported by a support roller 22*e*, and a belt cleaning device 26 that removes the adhered materials such as the toner and paper dust which remain to adhere to the outer surface of the intermediate image transfer belt 21 to clean the surface after passage thereof through the secondary image transfer device 25.

Among the plural support rollers 22*a* to 22*e* and a support roller 22*f* that support the intermediate image transfer belt 21, the support roller 22*a* is configured as a driving roller, the support roller 22*c* is configured as a tensioning roller, and the support roller 22*e* is configured as a secondary image transfer auxiliary roller. The primary image transfer devices 23 is a contact type transfer device that rotates in contact with the inner surface of the intermediate image transfer belt 21 and has a primary image transfer roller to which primary image-transferring bias is supplied. A direct-current voltage that shows the polarity opposite to the charge polarity of the developer or the like is supplied as the primary image-transferring bias. The secondary image transfer device 25 is a contact type transfer device that rotates in contact with the outer surface of the intermediate image transfer belt 21 and has a secondary image transfer roller to which secondary image-transferring bias is supplied. A direct-current voltage that shows the polarity opposite to the charge polarity of the developer or the like is supplied as the secondary image-transferring bias. The belt cleaning device 26 has substantially the same configuration as the drum cleaning devices 17. In FIG. 1, sign 26*a* illustrates a housing of the belt cleaning device 26, 26*b* illustrates a rotating brush, 26*c* illustrates a cleaning plate, and 26*e* illustrates s recovery transport member.

The sheet feeding device 30 is arranged to be present at a position on a further downstream side than the intermediate image transfer unit 20. The sheet feeding device 30 is configured mainly of a single (or plural) sheet accommodating body 31 in which the recording sheets 9 of desired size, type, and the like are accommodated in a stacked state, and a feed device 32 that feeds the recording sheets 9 from the sheet accommodating body 31 sheet by sheet. A heating rotating body 42 that rotates in the direction illustrated with the arrow and is heated by a heating unit such that a surface temperature is maintained at a predetermined temperature, and a pressurizing rotating body 43 that is driven to rotate, in contact at a predetermined pressure, in a state of substantially along with the axial direction of the heating rotating body 42 are arranged in a housing 41 of the fixing device 40.

In addition, in the housing 100 of the image forming apparatus 1, a supply transport path, which is configured to have plural sheet transport roller pairs 33*a*, 33*b*, 33*c*, . . . and a transport guide material, is disposed between the sheet feeding device 30 and the secondary image transfer position of the intermediate image transfer unit 20 (part where the intermediate image transfer belt 21 and the secondary image transfer device 25 come into contact with each other). In addition, a sheet transport device 34 of belt type or the like, which transports the recording sheet 9 after the secondary image transfer to the fixing device 40, is installed between the secondary image transfer device 25 and the fixing device 40. Further, a discharge transport path, which is configured to have plural transport roller pairs 45*a* and 45*b* and a transport guide material, is disposed on a discharge side of the fixing device 40. Furthermore, a discharge accommodating section (not illustrated), which accommodates the recording sheet 9 that is discharged from the discharge transport path after the image formation, is disposed at a site out of the housing 100 or the like.

The image formation by the image forming apparatus 1 is performed in the following manner. Herein, a basic image forming operation is described as an example, in which a full color image is formed on one surface of the recording sheet 9 through a combination of the toner of the above-described four colors (Y, M, C, and K).

In the image forming apparatus 1, the respective photoconductive drums 11 of the four imaging units 10 (Y, M, C, and K) rotate in the arrow direction first when there is an instruction of a demand for initiation of the image forming operation (printing), and the charging devices 12 charge the image holding surfaces of the respective photoconductive drums 11 with the required polarity and potential. Then, the exposure devices 13 perform exposure by irradiating the charged image holding surfaces of the photoconductive drums 11 with the light beams Bm, which are emitted based on the image data decomposed into each color component (Y, M, C, and K) sent from an image processing apparatus (not illustrated), such that the electrostatic latent images of the respective color components which have the required potential differences are formed. Then, the respective developing devices 14 (Y, M, C, and K) supply the two-component developers of the respective colors (Y, M, C, and K) charged with the required polarity to the electrostatic latent images of the respective color components formed on the respective photoconductive drums 11 so as to make the toner electrostatically adhere to the electrostatic latent images. In this manner, any one of the toner images of the four colors (Y, M, C, and K) is formed on the image holding surface of the photoconductive drum 11 of each of the photoconductive drums 11.

Next, the toner images of the respective colors that are formed on the photoconductive drums 11 of the respective imaging units 10 (Y, M, C, and K) are primary image-transferred, by the respective primary image transfer devices 23 of the intermediate image transfer unit 20, to be sequentially superposed on the outer surface of the intermediate image transfer belt 21 rotating in the arrow direction. After the completion of the primary image transfer, the photoconductive drums 11 are adjusted, with the corona discharge by the charge adjusting corona dischargers 16, to a charged potential at which the potential of the adhered material remaining on the image holding surface and the potential of the image holding surface are likely to be cleaned (facilitating the removal of the adhered material). In addition, after passing through the charge adjusting corona dischargers 16, the photoconductive drums 11 are cleaned by the drum cleaning devices 17 and then the image holding surfaces are erased by the charge removers 18 such that the subsequent image forming process is prepared.

Subsequently, in the intermediate image transfer unit 20, the toner images that are primary image-transferred onto the intermediate image transfer belt 21 are held and transported to the secondary image transfer position, and then the toner images on the intermediate image transfer belt 21 are secondary image-transferred in a lump by the secondary image transfer device 25 at the secondary image transfer position onto the recording sheets 9 which are transported through the supply transport path from the sheet feeding device 30. After the completion of the secondary image transfer, the outer surface of the intermediate image transfer belt 21 is cleaned by the belt cleaning device 26 such that the subsequent intermediate image transfer process is prepared.

Lastly, the recording sheets 9 where the toner images are secondary image-transferred are separated from the intermediate image transfer belt 21 and then are transported by the sheet transport device 34 to be introduced into the fixing device 40. Then, the toner images are fixed through required fixing processing (heating and pressurization) in the fixing device 40. When the image formation is performed only on the one surface during the image forming operation, the recording sheet 9 is discharged out of the housing 100 through the discharge transport path and is accommodated in the discharge accommodating section after the completion of the fixing.

In the image forming apparatus 1, the recording sheet 9 where the full color image, which is formed through the combination of the toner images of the four above-described colors (Y, M, C, and K), is formed is output through the operation described above. When there is an instruction for the image forming operation for plural sheets, a series of the above-described operations are repeated in the same manner to match the number of the sheets.

In the image forming apparatus 1, ozone and corona products that are generated through the corona discharge by the charge adjusting corona dischargers 16 adhere to and accumulate on the photoconductive drums 11 and cause an image defect (mainly uneven concentration). The suction device 5 that suctions the air which is present in and in the vicinity of the shield case 16*a* of the charge adjusting corona dischargers 16 along with the ozone and the corona products is installed, as illustrated in FIGS. 2A and 2B, in order to prevent this. The suction device 5 will be described in detail later.

In the image forming apparatus 1, the ozone and the corona products that are generated through the corona discharge in the charging devices 12 adhere to and accumulate on the discharge wires 12*b* and 12*c* and the photoconductive drums 11 and cause a charge failure (mainly uneven charging) and an image defect (mainly uneven image quality). In order to prevent this, air (arrow with the two-dot chain line) that is blown from a blower device (not illustrated) is sprayed into the shield case 12*a* of the charging devices 12 as illustrated in FIGS. 2A and 2B. In this manner, the ozone and the corona products are discharged out of the shield case 12*a*.

In addition, in the image forming apparatus 1, suction devices 80A and 80B that respectively suction and capture the ozone and the corona products of the air, which is present on both sites on the upstream side and the downstream side in the rotation direction across the developing devices 14 of the photoconductive drums 11, and the waste toner are arranged, as illustrated in FIGS. 2A and 2B, so as to suction and capture the ozone and the corona products discharged from the charging devices 12 through the spraying of the air and so as to suction and capture the toner floating or leaking due to the developing processes of the developing devices 14 in areas in front and behind the photoconductive drums 11 across the developing roller 14*d*.

The suction device 80A has a first suction duct 81 that has a first suction port 82 which faces a site between the charging device 12 and the developing device 14 on the image holding surface of the photoconductive drum 11, and a second suction duct 83 that has a second suction port 84 which faces a site of the photoconductive drum 11 between the first suction port 82 and the developing device 14, the first suction duct 81 and the second suction duct 83 being combined with each other, and exhaust ports of the respective suction ducts 81 and 83 are configured as a common exhaust port 85. In addition, the common exhaust port 85 is connected to a suction unit such as a suction fan (not illustrated) by piping. The suction device 80A suctions the ozone and the corona products that are discharged from the charging devices 12 from the first suction port 82 to the first suction duct 81 as is illustrated with the arrow with the two-dot chain line, suctions the floating or leaking toner from the second suction port 84 to the second suction duct 83 as is illustrated with the arrow with the two-dot chain line, and discharges the air or the like that is suctioned to the respective suction ducts 81 and 83 from the common exhaust port 85.

In addition, the suction device 80B has a third suction duct 86 that has a third suction port 87 which faces the site of the image holding surface of the photoconductive drum 11 until reaching the primary image transfer position after passing through the developing devices 14, and the third suction port 87 of the third suction duct 86 is connected to a suction unit (not illustrated) by piping. The suction device 80B suctions the waste toner leaking from the developing devices 14 and the like from the third suction port 87 to the third suction duct 86 as is illustrated with the arrow with the two-dot chain line and discharges the air or the like that is suctioned to the third suction duct 86 from the third suction port 87.

The ozone, the corona products, the toner, and the like that are discharged from the common exhaust port 85 and the exhaust port 87 are captured by capturing units such as filters which are respectively arranged at a site midway to the suction unit or at a site passing therethrough. The suction unit of the two suction devices 80A and 80B are combined, for example, into one.

<Suction Device>

Hereinafter, the suction device 5 will be described.

As illustrated in FIGS. 2A, 2B, 3A, 3B, and the like, the suction device 5 has a suction machine 50 that has a rotating fan which suctions air, and a suction duct 51 that is connected to the suction machine 50 and suctions and discharges the air which is present in and in the vicinity of the charge adjusting corona dischargers 16 where the suction of the air is required.

The suction machine 50 is driving-controlled to suction a required amount of air. Examples of the suction machine 50 include a centrifugal blower such as a sirocco fan and various blowers such as a cross flow fan and an axial flow blower. In addition, the suction machine 50 is structured to release the air or the like that is suctioned out of the housing 100 of the image forming apparatus 1. Furthermore, the capturing unit such as the filter is arranged at a suction side position, at an exhaust side position, or at both of the positions of the suction machine 50 so as to capture a waste material which is mixed with the suctioned air.

As illustrated in FIGS. 3A to 6 and the like, the suction duct 51 is shaped to have a suction port 52 that is arranged to substantially face a part (opening 16*d* of a back surface plate of the shield case 16*a*) of the charge adjusting corona discharger 16, which is an object of the suction of the air, in the longitudinal direction B to suction the air, an exhaust port 53 that is connected to the suction machine 50 and suctions out the air which is suctioned from the suction port 52, and a flow path (main body portion) 54 that connects the suction port 52 and the exhaust port 53 with each other to form a flow path space 54*a* causing the air to flow. In the suction device 5 according to the first exemplary embodiment, the suction port 52 of the suction duct 51 is physically apart from the charge adjusting corona discharger 16, and thus the suction port 52 and the opening 16*d* of the shield case 16*a* of the charge adjusting corona discharger 16 are connected with a connection duct 56.

As illustrated in FIGS. 3A to 5 and the like, the flow path 54 of the suction duct 51 is configured to have an exhaust flow path 54A, a first bent flow path 54B, and a second bent flow path 54C.

The exhaust port 53 is disposed in one end portion of the exhaust flow path 54A which is open and the other end portion of the exhaust flow path 54A is closed. The exhaust flow path 54A, as a whole, is a flow path with a rectangular cylinder shape that is formed to extend along the longitudinal direction B of the charge adjusting corona discharger 16. The first bent flow path 54B is a cylindrical flow path that is formed to extend, bent at a substantially right angle, substantially downward (direction substantially parallel to a coordinate axis Y) from the other end portion-sided site (midway) of the exhaust flow path 54A in a state where the width of the flow path space 54*a* is increased. The second bent flow path 54C is a cylindrical flow path that is formed to extend, bent in a horizontal direction (direction substantially parallel to a coordinate axis X), from one end portion of the first bent flow path 54B toward the charge adjusting corona discharger 16 in a state where the width of the flow path space remains unchanged.

The widths (dimensions along the longitudinal direction B) of the flow path spaces 54*a* of the respective first bent flow path 54B and the second bent flow path 54C are set to be substantially equal to each other. In addition, the suction port 52 is formed in a terminal end portion of the second bent flow path 54C. The suction port 52 is formed as an opening with an oblong opening shape that is slightly narrower than the cross-sectional shape of the flow path space of the one end portion (terminal end portion) of the second bent flow path 54C (Still, the length of the suction port 52 in the longitudinal direction is substantially equal to the width of the second bent flow path 54C).

The suction port 52 of the suction duct 51 is formed to have a long opening shape (for example, an oblong shape) that is parallel to a part (opening 16*d*) of the charge adjusting corona discharger 16 in the longitudinal direction B. The exhaust port 53 is formed to have a substantially square opening shape. A connection duct 55 that is connected to the suction machine 50, exerts a suction force of the suction machine 50, and suctions out the air from the exhaust port 53 is connected to the exhaust port 53 (FIGS. 3A, 3B, 4A, and 4B).

Accordingly, the suction duct 51 has a relationship in which the suction port 52 and the exhaust port 53 are formed to have different opening shapes. However, even when the suction port 52 and the exhaust port 53 have the same shape, the relationship in which the opening shares differ from each other is satisfied if the suction port 52 and the exhaust port 53 are formed to have different opening areas (similarity shapes). In addition, as illustrated in FIGS. 3A, 3B, 4A, 4B, and the like, the exhaust port 53 is formed to be present in a state of protruding by a required dimension G on a further outer side than one end portion 53*a* of the suction port 52 in the longitudinal direction B which has an oblong opening shape.

In the suction duct 51 that has the suction port 52 and the exhaust port 53 which have different opening shapes, apart where the cross-sectional shape of the flow path space 54*a* is changed midway is present in the flow path 54 that connects the suction port 52 and the exhaust port 53 with each other.

In the suction duct 51 according to the first exemplary embodiment, the suction port 52 has an oblong opening shape whereas the exhaust port 53 has a square opening shape, which differ from each other, and thus bent parts (in actuality, the first bent flow path 54B and the second bent flow path 54C) are present in (the flow path space 54*a* of) the flow path 54. As a result, in the suction duct 51, particularly the flow path space 54*a* of the exhaust flow path 54A has a substantially square cross-sectional shape whereas the flow path space 54*a* of the first bent flow path 54B and the second bent flow path 54C is changed to a substantially oblong cross-sectional shape (without any change in height) which widens only in a substantially horizontal direction. In other words, the cross-sectional shape of the flow path space 54*a* of the first bent flow path 54B and the second bent flow path 54C is the cross-sectional shape of the flow path space 54*a* that is rapidly widened in the substantially horizontal direction with respect to the exhaust flow path 54A.

However, in the suction duct 51 where the part with the changed cross-sectional shape of the flow path space 54*a* is present, disturbance such as separation and a vortex is generated in air flow at the part where the cross-sectional shape changes. Accordingly, in the suction duct 51, the wind speed of the air that is suctioned from the suction port 52 tends to become non-uniform even when the air is emitted from the exhaust port 53 at a uniform wind speed. In actuality, the wind speed tends to be high at a site (one end portion or the like) of the suction port 52 that is on a side close to the exhaust port 53, and the wind speed at the other sites tends to be low (refer to FIG. 14).

The above-described tendency of the wind speed of the air suctioned by the suction port 52 becoming non-uniform in the end occurs in substantially the same manner when an air flow (travel) direction in the suction duct 51 changes, that is, when the flow path space 54*a* has a bent shape midway regardless of the presence or absence of a change in the cross-sectional shape of the flow path space 54*a*. Furthermore, the tendency of the wind speed of the air suctioned by the suction port 52 becoming non-uniform in the end occurs more considerably when the cross-sectional shape of the flow path space 54*a* changes and the air flow (travel) direction changes in addition thereto.

Figure 12A:
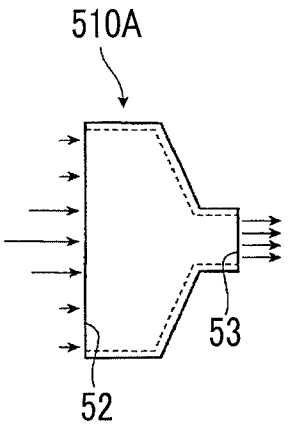
FIGS. 12A to 12D are explanatory top views illustrating other shape examples of the suction duct.
Figure 12B:
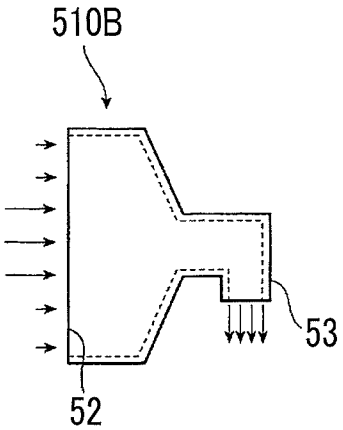
Figure 12C:
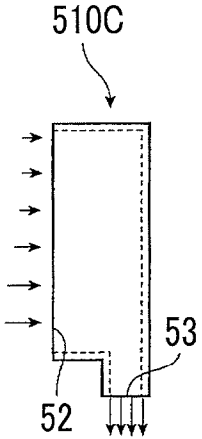
Figure 12D:
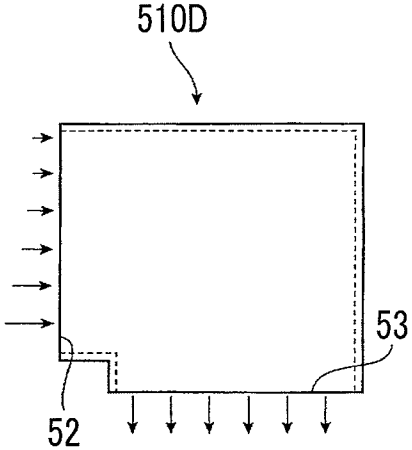

FIGS. 12A to 12C illustrate representative examples 510A to 510X of the suction duct where the suction port 52 and the exhaust port 53 are formed to have different opening shapes. In the drawings, respective states of the wind speed of the air suctioned by the suction port 52 of each of the ducts 510 and the wind speed of the air coming out of the exhaust port 53 are respectively illustrated with the length of the arrows. The longer the length of the arrow is, the faster the wind speed. The shorter the length of the arrow is, the slower the wind speed. FIGS. 12A to 12C illustrate the respective suction ducts 510 viewed from upper surface sides thereof. In addition, the arrows with the same length in the drawings illustrate the same wind speed. Furthermore, the dotted lines in the drawings illustrate (side wall portions forming) the flow path spaces of the respective ducts. The suction ducts 510B and 510X are configuration examples in which the air flow direction changes midway (the flow path space 54*a* is bent midway) at least one of the cross-sectional shape and the cross-sectional area of the flow path space changes. A suction duct 510D illustrated in FIG. 12D is a configuration example in which the suction port 52 and the exhaust port 53 are formed to have the same opening shape (and the same opening area), and is a duct where only the air flow direction changes midway.

As illustrated in FIGS. 3A to 6 and the like, the flow path 54 in which the flow path space 54*a* that connects the suction port 52 and the exhaust port 53 with each other to cause the air to flow is formed at one or more place (two places in this example) with a bent shape, and two flow control members 61 and 62 that control the air flow to a site with an air flow direction (R) different from the flow path space 54*a* of the flow path 54 are disposed in the suction duct 51 of the suction device 5 according to the first exemplary embodiment.

Of the two flow control members 61 and 62, the flow control member 61 is an "uppermost stream flow control member" that is disposed at an upstream side site of the flow path space 54*a* of the flow path 54 in the air flow direction in a state of being blocked by a permeable member 70. In the first exemplary embodiment, the upstream side site is the suction port 52 that is the uppermost stream site.

The permeable member 70 is a member which has, for example, plural ventilation portions 71. As illustrated in FIGS. 5 and 6, each of the plural ventilation portions 71 is a through-hole that linearly extends to penetrate with a substantially circular opening shape. In addition, the plural ventilation portions 71 are aligned at regular intervals along, for example, the longitudinal direction B of the opening shape of the suction port 52, and four rows of the ventilation portions 71 are aligned at intervals equal to the regular intervals also in a lateral direction C which is orthogonal to the longitudinal direction B. In this manner, the plural ventilation portions 71 are formed to be dotted across an entire area of the opening shape of the suction port 52, which is the uppermost stream end of the exhaust flow path 54A. Accordingly, the permeable member 70 according to the first exemplary embodiment is a porous plate where the plural ventilation portions (holes) 71 are formed in a plate-shaped member. Furthermore, it is preferable that the plural ventilation portions 71 be formed to be present to be substantially uniformly disposed (at a substantially constant density) with respect to an opening area of the suction port 52. However, the plural ventilation portions 71 may be formed to be present in a state of slight density insofar as the wind speed of the air suctioned from the suction port 52 causes no error.

The permeable member 70 may be formed to be integrally molded with the suction duct 51 by using the same material or may be formed by using a different material from the material of the suction duct 51. The opening shape, the opening dimension, the hole length, and the density of the presence of the hole of the ventilation portion (hole) 71 are selectively set from the viewpoint of uniformizing the wind speed of the air suctioned through the suction port 52 as much as possible. In addition, these values are set allowing for the dimension (capacity) of the suction duct 51 and the flow amount of the air per unit time to be suctioned by the suction duct 51 or suctioned from the charge adjusting corona discharger 16.

Of the two flow control members 61 and 62, the other flow control member 62 is a "lowermost stream flow control member" that is disposed at a required site of the first bent flow path 54B, as illustrated in FIGS. 3A to 5 and the like, which blocks a part of the first bent flow path 54B in a crossing state and allows the air to pass by the presence of a gap 63 extending in the crossing direction D.

The lowermost stream flow control member 62 is configured by arranging a plate-shaped blocking member 64 in a crossing state with the gap 63 with respect to a one side surface of the cross-sectional shape of the flow path space 54*a* in the flow path space 54*a* of the first bent flow path 54B without changing the appearance of the first bent flow path 54B. Specifically, the blocking member 64 blocks one side wall surface part of the cross-sectional shape of the flow path space 54*a* of the first bent flow path 54B in a crossing state as illustrated in FIG. 5 and the like, and one end portion 64*a* that forms the gap 63 of the blocking member 64 is arranged, with a required gap H, with respect to one side wall surface portion of the cross-sectional shape of the flow path space 54*a*. In this manner, the lowermost stream flow control member 62 has a structure in which the elongated and substantially oblong gap 63, which extends in the crossing direction D, is present on the side wall portion that is one end of the blocking member 64 of the flow path space 54*a*.

The height H, the path length M, and the width (length of the longitudinal direction B) W of the gap 63 that constitutes the lowermost stream flow control member 62 are selectively set from the viewpoint of uniformizing the wind speed of the air flowing from the second bent flow path 54C into the first bent flow path 54B as much as possible and causing the air to flow to the exhaust flow path 54A. In addition, these values are set allowing for the dimension (capacity) of the suction duct 51 and the flow amount of the air per unit time suctioned by the suction duct 51 or suctioned from the charge adjusting corona discharger 16.

Hereinafter, an operation of the suction device 5 will be described.

Figure 7A:
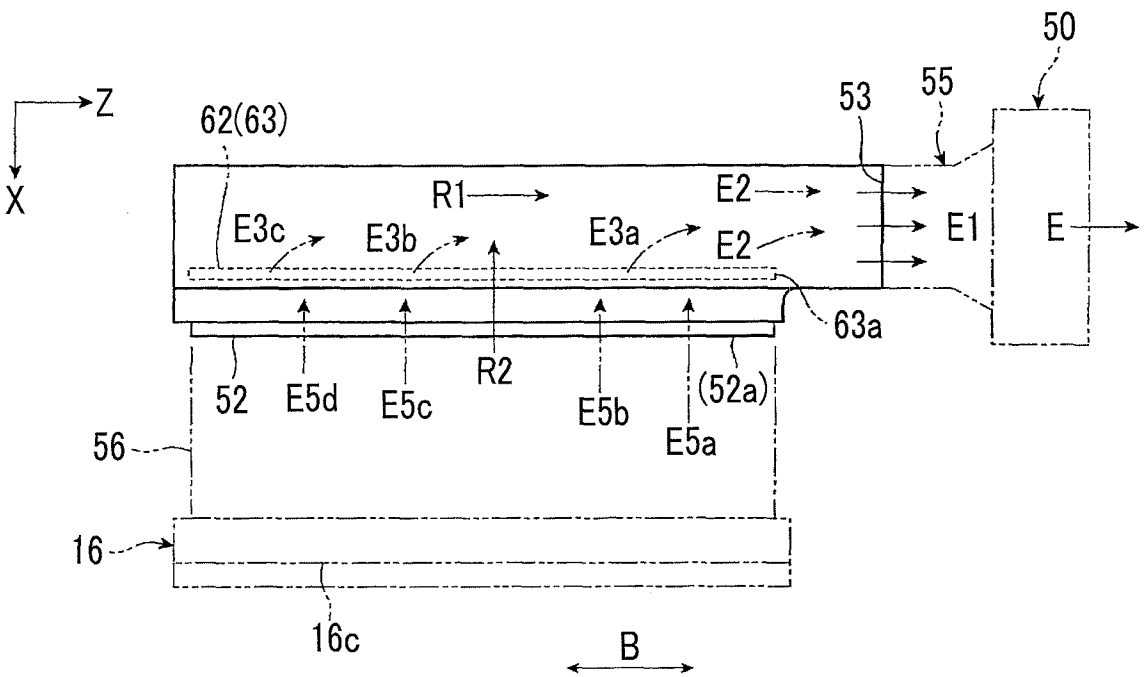
FIGS. 7A and 7B are schematic explanatory views illustrating a state where an air flow direction and state in the suction duct of FIGS. 3A and 3B are viewed from above.
Figure 7B:
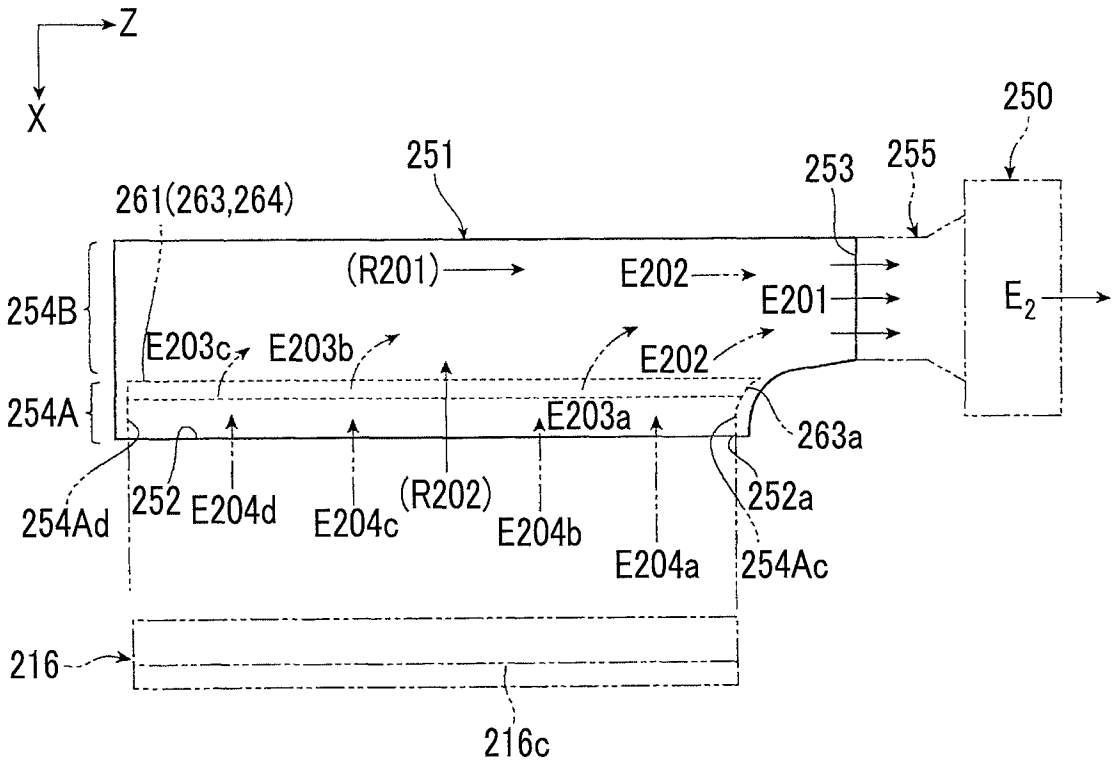
Figure 8:
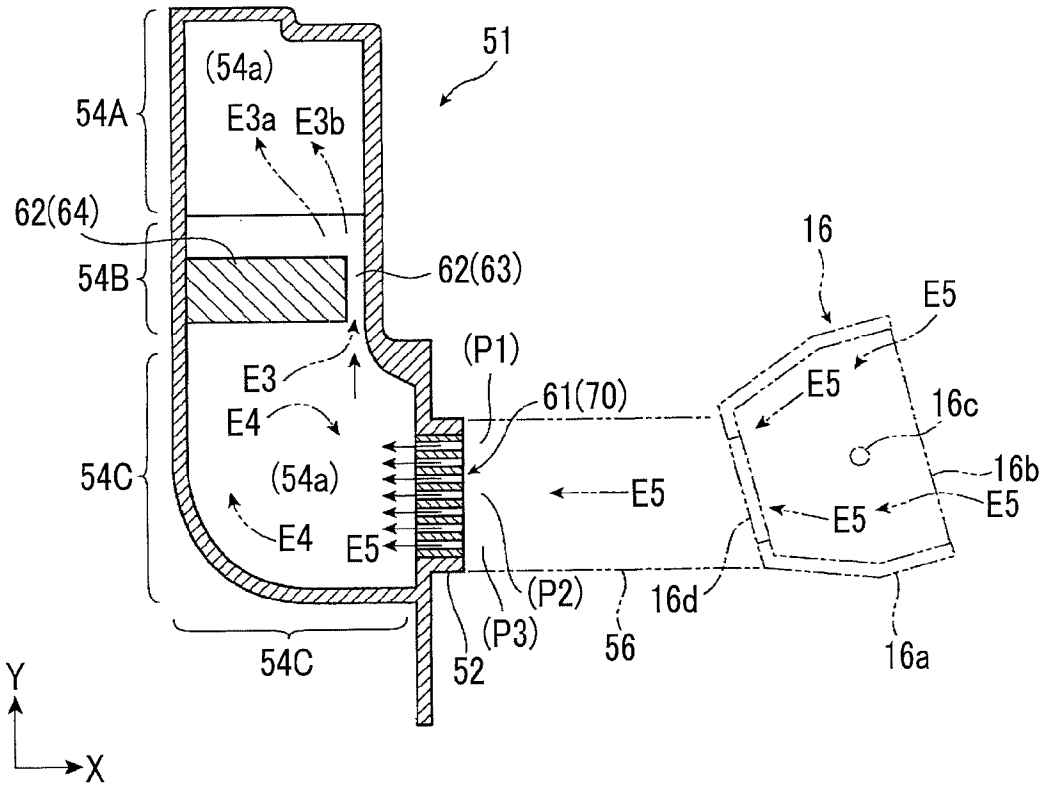
FIG. 8 is a schematic explanatory view illustrating a state where the air flow direction and state in the suction duct of FIGS. 3A and 3B are viewed in the cross-sectional state illustrated in FIG. 5.

The suction device 5 suctions a required volume of air first, with the suction machine 50 being driven to rotate, during a driving setting period such as during the image forming operation. When the suction machine 50 is ignited, an operation for suctioning and discharging air (E200) is initiated in the suction machine 50 as illustrated in FIGS. 7A, 7B, and 8. A suction force of the air that is generated by the operation of the suction machine 50 is exerted on the suction duct 51 through the connection duct 55. In this manner, the suction of the air (E200) is initiated at the suction port 52 in the suction duct 51.

In this case, air (E2) that is present in the flow path space 54*a* of the exhaust flow path 54A of the suction duct 51 is suctioned out from the exhaust port 53 first due to the suction force of the suction machine 50. In this manner, the air (E2) that is present in the flow path space 54*a* of the exhaust flow path 54A flows substantially along a direction R1 in which the air in the flow path space 54*a* should flow. Lastly, the air (E2) passes through the exhaust port 53 as air (E1), which is settled in the front of the exhaust port 53, and flows out to the connection duct 55. When the air is suctioned out from the exhaust port 53 in this manner, the suction force of the suction machine 50 is exerted in the flow path space 54*a* of the exhaust flow path 54A.

Then, air (E3) that is present in the flow path space 54*a* of the first bent flow path 54B is suctioned and moved into the flow path space 54*a* of the exhaust flow path 54A due to the suction force of the suction machine 50 exerting in the flow path space 54*a* of the exhaust flow path 54A. In this case, the air (E3) passes through the gap 63 of the lowermost stream flow control member 62 in the flow path space 54*a* of the first bent flow path 54B as illustrated in FIG. 8 and flows into the flow path space 54*a* of the exhaust flow path 54A.

In this case, the air (E3) that is present in the flow path space 54*a* of the first bent flow path 54B flows along an air flow direction R2 of the flow path space 54*a*, but the traveling of a part thereof is blocked by the blocking member 64 of the lowermost stream flow control member 62 and the other part is in a controlled state (state where the pressure is raised) after passing through the elongated and narrow gap 63 of the lowermost stream flow control member 62 to flow into the flow path space 54*a* of the exhaust flow path 54A from the gap 63.

In this manner, the air (E3) that is suctioned and flows from the first bent flow path 54B to the exhaust flow path 54A tends to flow as air (E3*a*), which is extremely leaned state, after almost passing through an area in an end portion on a side close to the exhaust port 53 (in actuality, the suction machine 50) of the first bent flow path 54B (refer to FIG. 14) when the lowermost stream flow control member 62 is absent. However, when the lowermost stream flow control member 62 is present, a large amount of air (E3*b* and E3*c*) that passes also through an area to an end portion on the side opposite to the area of the end portion on the side close to the exhaust port 53 of the first bent flow path 54B is present as illustrated in FIG. 8. When the air (E3) passes through the gap 63 of the lowermost stream flow control member 62, the suction force of the suction machine 50 is exerted in the flow path space 54*a* of the first bent flow path 54B and the suction force in this case is also exerted in the flow path space 54*a* of the second bent flow path 54C which continues from the first bent flow path 54B.

Lastly, air (E5) that is present out of the suction port 52 is suctioned into the flow path space 54*a* of the second bent flow path 54C through the suction port 52 due to the suction force of the suction machine 50 which is exerted in the flow path space 54*a* of the first bent flow path 54B and the second bent flow path 54C. In this case, the air (E5) passes through the permeable member 70 that constitutes the uppermost stream flow control member 61 which is disposed in the suction port 52 and flows into the flow path space 54*a* of the second bent flow path 54C. Herein, the air (E5) is present in the connection duct 56 between the suction duct 51 and the charge adjusting corona discharger 16 in the first exemplary embodiment. However, in actuality, the air (E5) is air that is present in and in the vicinity of the shield case 16*a* of the charge adjusting corona discharger 16.

In this case, the air (E5) that is present out of the suction port 52 is suctioned from the suction port 52 of the suction duct 51. However, in this case, the air (E5) passes through the plural ventilation portions (holes) 71 of the permeable member 70 that constitutes the uppermost stream flow control member 61 and flows into the flow path space 54*a* of the second bent flow path 54C. When the air is suctioned from the suction port 52 in this manner, the suction force of the suction machine 50 is exerted out of the suction port 52.

In this manner, the air (E5) that is suctioned from the suction port 52 passes through the plural ventilation portions 71 of the permeable member 70 with a relatively narrower opening area than the opening area of the suction port 52 to be suctioned in a state where the flow is controlled (in a state where the pressure is raised also in this case).

In addition, the air (E5) that is suctioned from the suction port 52 passes through the plural ventilation portions 71 that are dotted over the entire opening area of the suction port 52 and formed under the same conditions, and thus becomes uniform from the area substantially close to the opening shape of the suction port 52 and is in an environment where the air (E5) is suctioned from the suction port 52. However, in actuality, the speed of the air (E3*a*) that passes through the area of an end portion 63*a* of the gap 63 on the side close to the exhaust port 53 becomes the fastest in the air (E3) at a time of flowing to pass through the gap of the lowermost stream flow control member 62 due to the suction force of the suction machine 50 in the longitudinal direction B of the suction port 52 as illustrated in FIGS. 7A and 7B, and the speed of the air (E3*b* and E3*c*) passing through the respective areas gradually separated from the end portion 63*a* of the gap 63 is subjected to being gradually slowed due to the separation. In other words, in the longitudinal direction B of the suction port 52, the speed of air (E5*a*) passing through the area of an end portion 52*a* of the suction port 52 on a side close to the exhaust port 53 becomes the fastest as illustrated in FIGS. 7A and 7B, and the speed of the air (E5*b*, E5*c*, and E5*d*) passing through the respective areas gradually separated from the end portion 52*a* of the suction port 52 becomes gradually slowed. Still, the wind speed difference of the air (E5) in the longitudinal direction B of the suction port 52 in this case is a difference causing no practical problem (refer to FIG. 9).

The air (E5) suctioned from the suction port 52 as described above passes through the plural ventilation portions 71 of the permeable member 70 of the uppermost stream flow control member 61 to be suctioned with the traveling direction thereof aligned in the direction substantially orthogonal to the longitudinal direction B of the suction port 52, and the air suction velocity in the longitudinal direction B of the suction port 52 is controlled to be considerably different. In addition, the wind speed of the air (E5) suctioned from the suction port 52 is controlled to be considerably different in the longitudinal direction B of the opening shape (oblong shape) of the suction port 52 and is controlled to be considerably different in the lateral direction C (refer to FIGS. 6, 8, and the like) substantially orthogonal to the longitudinal direction B.

As illustrated in FIG. 8, the air (E5) that is suctioned from the suction port 52 into the flow path space 54*a* of the second bent flow path 54C is connected in a bent state to the first bent flow path 54, and thus stays in a temporarily circulating state in the flow path space combined with the flow path space 54*a* of the first bent flow path 54 (part on a further upstream side in the air flow direction R2 than the lowermost stream flow control member 62). In this manner, the air (E5) that is suctioned with the speed difference in the longitudinal direction B (and the lateral direction C) of the suction port 52 is mixed due to the temporary circulating stay and, as a result, the speed difference is alleviated and is cancelled to some extent.

The suction force of the air (E5) in the suction port 52 of the suction duct 51 is exerted also in the shield case 16*a* of the charge adjusting corona discharger 16 and the opening 16*b* thereof via the connection duct 56. In this manner, the air that is present in the shield case 16*a* of the charge adjusting corona discharger 16 and the air that is present in the vicinity of the opening 16*b* are suctioned from the suction port 52 of the suction duct 51.

In this case, the suction of the air in the suction port 52 of the suction duct 51 is allowed such that the suction of the air with little unevenness in the longitudinal direction B of the suction port 52 since the air suction velocity in the longitudinal direction B of the suction port 52 is controlled not to be considerably different, and thus the air (E5) that is present in the shield case 16*a* of the charge adjusting corona discharger 16 is also suctioned in the suction duct 51 at the substantially same speed in the longitudinal direction B of the shield case 16*a*.

In this manner, during the operation of the charge adjusting corona discharger 16, the ozone and the corona products that are generated in and in the vicinity of the shield case 16*a* are suctioned substantially uniformly along with the air (E5) in the longitudinal direction B of the shield case 16*a*. Accordingly, in the imaging units 10 (Y, M, C, and K) in which the suction device 5 is installed, the generation of defects of the image quality such as concentration unevenness due to, for example, the suction of the air by the suction device performed extremely leaned in the axial direction of the photoconductive drum 11, which causes the ozone and the corona products that are generated in the charge adjusting corona discharger 16 adhere and accumulate in a state of being leaned in the axial direction of the image holding surface of the photoconductive drum 11 corresponding to the side where the suction of the air by the suction device is relatively weak, may be controlled.

Wind Speed Distribution in Suction Port

Figure 9:
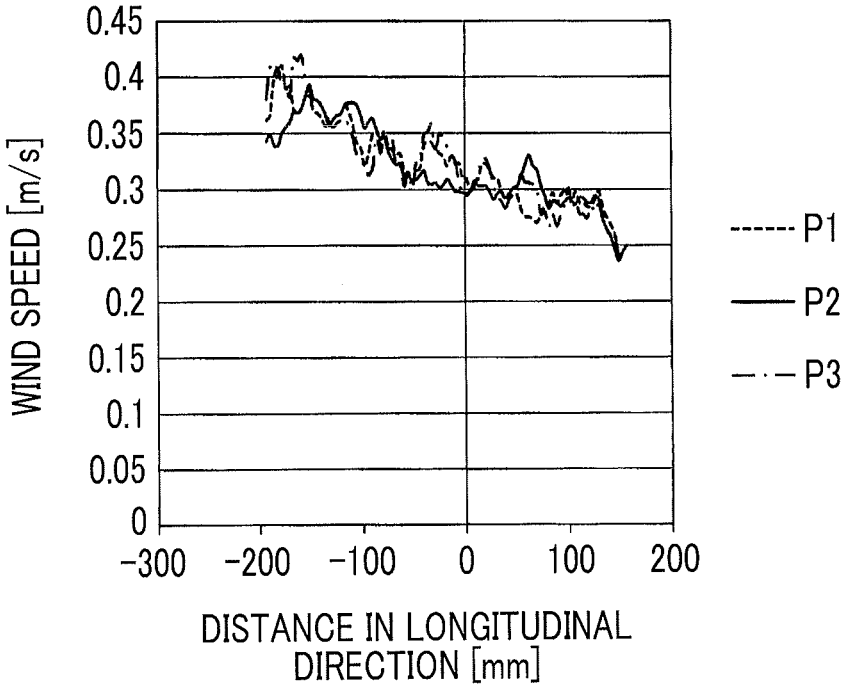
FIG. 9 is a graph chart illustrating a result of a simulation in which a state of wind speed (distribution) in the suction port of the suction duct of FIGS. 3A and 3B is analyzed.

FIG. 9 illustrates a result of a simulation that is performed with regard to the wind speed distribution in the suction port 52 of the suction duct 51 of the suction device 5.

The simulation is performed on the assumption of the following conditions, in which the suction duct 51 has an overall shape which is illustrated in FIGS. 3A to 6 and the like.

The suction duct 51 having the suction port 52 with an oblong opening shape of 17.5 mm×350 mm and the exhaust port 53 with a substantially square opening shape of 22 mm×23 mm is used as the suction duct. A polyhedral mesh as the permeable member 70, which is disposed on condition that the ventilation portion 71 with a hole diameter of 0.3 mm and a length of 3 mm is disposed at a density of 0.42 units/$mm^2$ (≅42 units/$cm^2$) is used as the uppermost stream flow control member 61. The lowermost stream flow control member 62 is configured to have a path length M of 8 mm and a width W of 345 mm, with the height H of the gap 63 being 1.5 mm on average, at a site having a position shifted by a dimension N=6 mm (FIG. 5) from a bottom end portion 53*d* of the exhaust port 53 to an upstream side of the first bent flow path 54B in the air flow direction R2.

In addition, the simulation assumes that the air with a volume at which the average wind speed of the air suctioned out from the exhaust port 53 of the suction duct 51 is approximately 10 m per second is suctioned from the suction machine 50, and the wind speed of the suction port 52 in the longitudinal direction B in this case is measured. As illustrated in FIG. 8, the measurement is performed through respective movements across the entire area in the longitudinal direction B with regard to the three positions of an upper position P1 in an up-down direction (direction substantially parallel to the coordinate axis Y) of the suction port 52, an intermediate position P2, and a lower position P3. This simulation uses thermal fluid analysis software (number of iterations: 1,000 times) for the analysis. The physical model of "k-ω SST model (focusing on velocity boundary near the wall surface)" is applied to the simulation, and "Hybrid Wall Function (0.1<Y+<100)" is applied as a wall surface model.

In the graph of FIG. 9, a position where a position of the horizontal axis in the longitudinal direction (substantially same as the axial direction of the photoconductive drum) is "0 mm" corresponds to a central position of the suction port 52 in the longitudinal direction B. In addition, a minus side (left side in the drawing) among the positions of the horizontal axis in the longitudinal direction is an area of the end portion 52*a* on the side close to the suction port 52 of the suction duct 51.

Figure 13A:
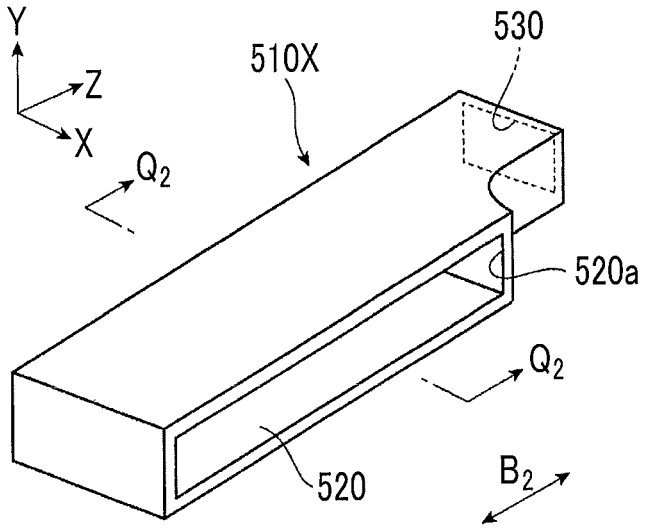
Figure 13B:
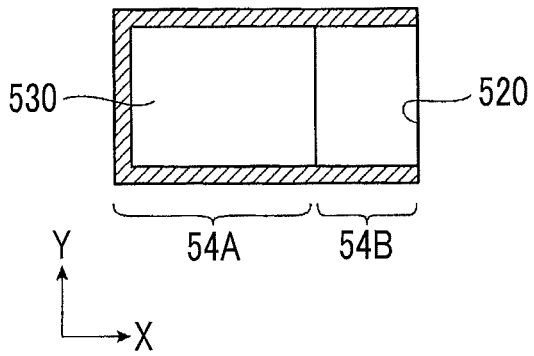

For reference, the simulation is performed in the same manner assuming the suction duct (comparative example) 510X in general used in a suction device of the related art as illustrated in FIGS. 13A and 13B.

The suction duct 510X has an overall shape that is illustrated in FIGS. 12C, 13A and 13B and the simulation is performed assuming the following conditions. The suction duct 510X having a suction port 520 with an oblong opening shape of 17.5 mm×350 mm and an exhaust port 530 with a substantially square opening shape of 22 mm×23 mm is used as the suction duct. The flow control members 61 and 62 as in the suction duct 51 according to the first exemplary embodiment are not disposed in the suction duct 510X.

Figure 14:
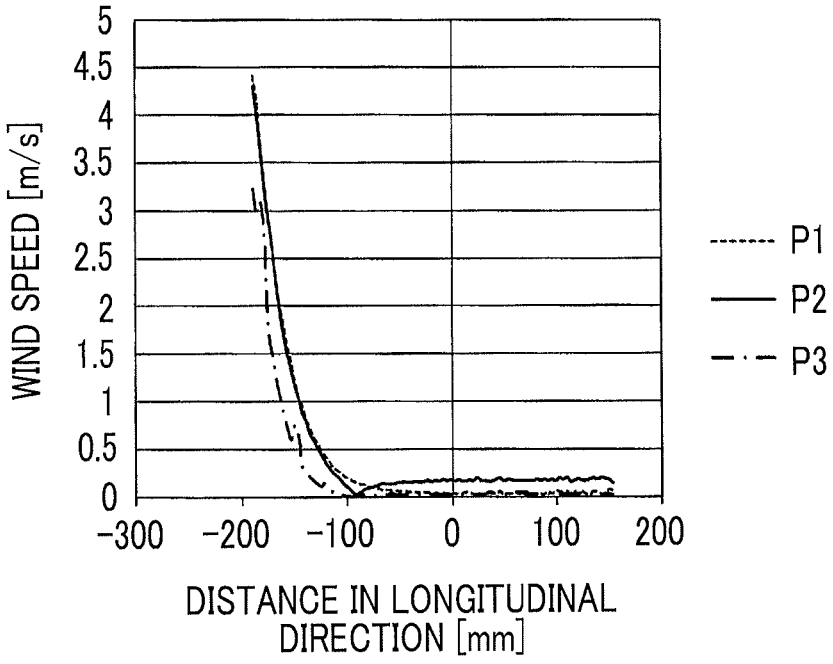
FIG. 14 is a graph chart illustrating a result of a simulation in which a state of wind speed (distribution) in the suction port of the suction duct of FIGS. 13A and 13B is analyzed.

FIG. 14 illustrates the result of the simulation in this case.

As is apparent in the result illustrated in FIG. 14, in the suction duct 510X of the related art, with respect to the wind speed of an area in an end portion 520*a* on a side close to the exhaust port 530 of the suction port 520, the wind speed of an area (area on a side far from the exhaust port 530) of the suction port 520 other than the area is extremely low, and the air suction velocity distribution in the longitudinal direction B of the suction port 520 is extremely leaned.

In contrast, as is apparent in the result illustrated in FIG. 9, the air suction velocity distribution in the longitudinal direction B of the suction port 52 is controlled from a leaned state in the suction duct 51 which has the plural flow control members 61 and 62 of the first exemplary embodiment.

(Second Exemplary Embodiment)

Figure 10:
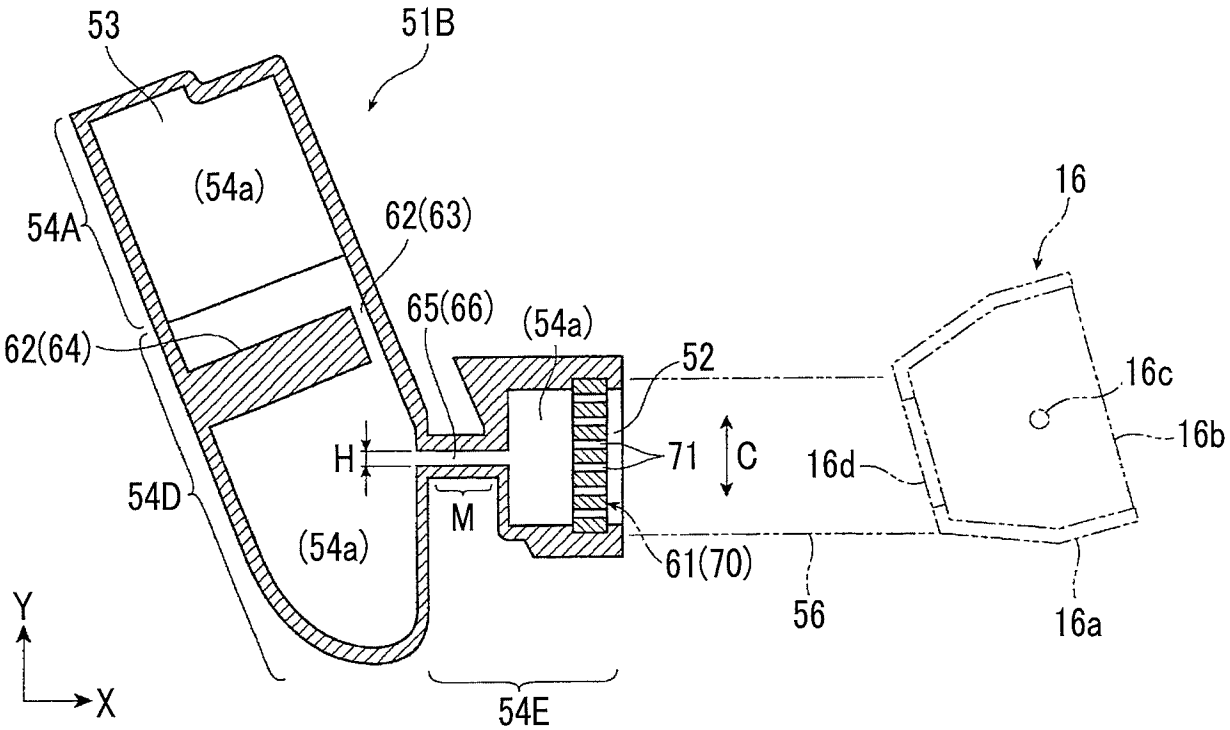
FIG. 10 is a cross-sectional explanatory view illustrating mainly a suction duct of a suction device according to a second exemplary embodiment by following FIG. 5.

FIG. 10 illustrates an air suction device according to a second exemplary embodiment, which illustrates a suction duct 51B of the suction device (5B).

The suction device 5B has the same configuration as the suction device 5 according to the first exemplary embodiment except that the suction device (5B) is changed to use the suction duct 51B, which has a partially different configuration. As illustrated in FIG. 10, in the suction duct 51B, the first bent flow path 54B and the second bent flow path 54C of the first exemplary embodiment are changed to a first bent flow path 54D and a second bent flow path 54E with different configurations, and a third flow control member 65 is added for change. Except for these, the suction duct 51B has the same configuration as the suction duct 51 of the first exemplary embodiment. In the following description, the same reference numerals are attached to the common components, and description of the components will be omitted when the description is redundant.

The first bent flow path 54D of the suction duct 51B is changed such that a part on an upstream side of the flow path space 54*a* in the air flow direction R2 is shaped to have a gradually decreasing height toward the downstream side. In addition, the second bent flow path 54E of the suction duct 51B is changed to be formed to extend toward the charge adjusting corona discharger 16, bent in a substantially horizontal direction, from a site (side surface portion) that is a substantially middle point of the first bent flow path 54D in the air flow direction R2 in a state where the width of the flow path space 54*a* (dimension along the longitudinal direction B) remains unchanged and to have the suction port 52, which has the substantially same opening shape (oblong shape) as the cross-sectional shape of the flow path space 54*a* of the terminal end portion, formed at a terminal end portion of the second bent flow path 54E.

In addition, the third flow control member (middle flow control member) 65 is disposed at a site between the uppermost stream flow control member 61 and the lowermost stream flow control member 62 in the air flow direction of the flow path space 54*a*. Specifically, the third flow control member 65 is disposed at a site on a downstream side in the air flow direction of the flow path space 54*a* of the second bent flow path 54E. In addition, the middle flow control member 65 is configured to be shaped to have an elongated and oblong gap 66 that extends in a direction which is parallel to the longitudinal direction B of the opening shape of the suction port 52.

The middle flow control member 65 of the second exemplary embodiment is changed in shape to squeeze the appearance of the second bent flow path 54E and is configured to be formed to have a shape with which the gap (narrow path) 66, which is in a narrowed state in a substantially central portion of the flow path space 54*a* of the second bent flow path 54E, is present. In addition, the height H, the path length M, and the width W of the gap 66 are selectively set from the viewpoint of uniformizing the wind speed of the air flowing from the first bent flow path 54D to the second bent flow path 54E as much as possible substantially as in the case of the gap 63 of the lowermost stream flow control member 62, and are set allowing for the dimension (capacity) of the suction duct 51B and the flow amount of the air per unit time which should be suctioned out from the entire flow path space 54*a* of the suction duct 51B or the charge adjusting corona discharger 16.

Hereinafter, an operation of the suction device (5B) will be described.

In this suction device, the air suction force that is generated through the operation of the suction machine 50 is exerted in the suction duct 51 through the connection duct 55, and the suction of the air (E200) is initiated in the suction port 52 in the suction duct 51B.

In this case, the air (E2) that is present in the flow path space 54*a* of the exhaust flow path 54A of the suction duct 51B is suctioned out from the exhaust port 53 due to the suction force of the suction machine 50 as in the case with the suction duct 51 according to the first exemplary embodiment. In this manner, the air (E2) that is present in the flow path space 54*a* of the exhaust flow path 54A passes through the exhaust port 53 in the end as the air (E1), which is settled in the front of the exhaust port 53, and flows out to the connection duct 55. When the air (E2) is suctioned out from the exhaust port 53 in this manner, the suction force of the suction machine 50 is exerted in the flow path space 54*a* of the exhaust flow path 54A.

Figure 11:
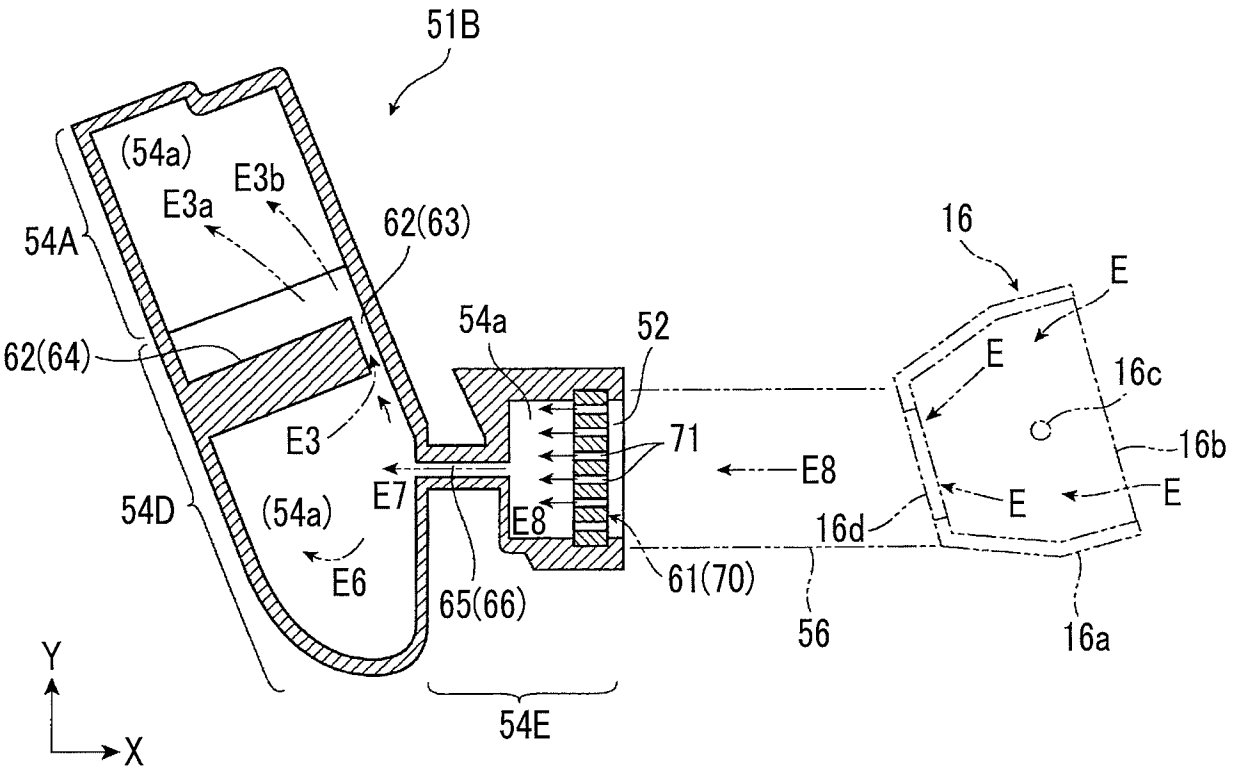
FIG. 11 is a schematic explanatory view illustrating a state where an air flow direction and state in the suction duct of FIG. 10 are viewed in the cross-sectional state illustrated in FIG. 10.

Then, the air (E3) that is present in the flow path space 54*a* of the first bent flow path 54D is suctioned and moved into the flow path space 54*a* of the exhaust flow path 54A due to the suction force of the suction machine 50 exerting in the flow path space 54*a* of the exhaust flow path 54A. In this case, the air (E3) passes through the gap 63 of the lowermost stream flow control member 62 in the flow path space 54*a* of the first bent flow path 54D as illustrated in FIG. 11 and flows into the flow path space 54*a* of the exhaust flow path 54A.

In this case, the air (E3) that is present in the flow path space 54*a* of the first bent flow path 54D flows along the air flow direction R2 of the flow path space 54*a*, but the traveling of a part thereof is blocked by the blocking member 64 of the lowermost stream flow control member 62 and the other part is in a controlled state (state where the pressure is raised) after passing through the elongated and narrow gap 63 of the lowermost stream flow control member 62 to flow into the flow path space 54*a* of the exhaust flow path 54A from the gap 63.

In this manner, also in the suction duct 51B, a large amount of the air (E3*b* and E3*c*) that passes also through the area to the end portion on the side opposite to the area of the end portion on the side close to the exhaust port 53 of the first bent flow path 54D is present (refer to FIG. 8) as in the case of the suction duct 51 according to the first exemplary embodiment. When the air (E3) passes through the gap 63 of the lowermost stream flow control member 62, the suction force of the suction machine 50 is exerted in the flow path space 54*a* of the first bent flow path 54D and the suction force in this case is exerted in the flow path space 54*a* of the first bent flow path 54D.

Subsequently, air (E7) that is present in the flow path space 54*a* of the second bent flow path 54E is suctioned and moved into the flow path space 54*a* of the first bent flow path 54D due to the suction force of the suction machine 50 which is exerted in the flow path space 54*a* of the first bent flow path 54D. In this case, the air (E7) passes through the gap 66 of the middle flow control member 65 in the flow path space 54*a* of the second bent flow path 54E as illustrated in FIG. 11, and flows into the flow path space 54*a* of the first bent flow path 54D.

In this case, the air (E7) that is present in the flow path space 54*a* of the second bent flow path 54E flows along the air flow direction R2 of the flow path space 54*a*, but flows into the flow path space 54*a* of the first bent flow path 54D from the gap 66 in a state of being controlled after passing through the elongated and narrow gap 66 of the middle flow control member 65 (state where the pressure is raised). When the air (E7) passes through the gap 66 of the middle flow control member 65, the suction force of the suction machine 50 is exerted in the flow path space 54*a* of the second bent flow path 54E.

In this manner, also in the suction duct 51B, a large amount of air (E7*b* and E7*c*) that passes also through the area to the end portion on the side opposite to the area of the end portion on the side close to the exhaust port 53 of the second bent flow path 54E is present as in the case, of the suction duct 51 according to the first exemplary embodiment. In addition, the air (E7) that flows into the flow path space 54*a* of the first bent flow path 54D stays in a temporarily circulating state in the flow path space 54*a* of the second bent flow path 54E and in the flow path space 54*a* of the first bent flow path 54D with larger in volume than the space of the gap 66. In this manner, the air (E7) that is suctioned with the speed difference in the longitudinal direction B of the flow path space 54*a* of the first bent flow path 54D is mixed due to the temporary circulating stay as is the case with the air (E6) and, as a result, the speed difference is alleviated and is cancelled to some extent.

Lastly, air (E8) that is present out of the suction port 52 is suctioned into the flow path space 54*a* of the second bent flow path 54E through the suction port 52 of the suction duct 51B due to the suction force of the suction machine 50 which is exerted in the flow path space 54*a* of the second bent flow path 54E. In this case, the air (E8) passes through the permeable member 70 that constitutes the uppermost stream flow control member 61 which is disposed in the suction port 52 and flows into the flow path space 54*a* of the second bent flow path 54C.

In this case, the air (E8) that is present out of the suction port 52 is suctioned from the suction port 52 of the suction duct 51B. However, in this case, the air (E8) passes through the plural ventilation portions (holes) 71 of the permeable member 70 that constitutes the uppermost stream flow control member 61 and flows into the passing space 54*a* of the second bent flow path 54E. When the air is suctioned in the suction port 52 in this manner, the suction force of the suction machine 50 is exerted out of the suction port 52.

In this manner, the air (E8) that is suctioned from the suction port 52 of the suction duct 51B passes through the plural ventilation portions 71 of the permeable member 70 with a relatively narrower opening area than the opening area of the suction port 52 to be suctioned in a state where the flow is controlled (in a state where the pressure is raised also in this case).

In addition, the air (E8) that is suctioned from the suction port 52 of the suction duct 51B passes through the plural ventilation portions 71 that are dotted over the entire opening area of the suction port 52 and formed under the same conditions, and thus becomes uniform from the area substantially close to the opening shape of the suction port 52 and is in an environment where the air (E8) is suctioned from the suction port 52. However, in actuality, the speed of the air (E3*a* and the like) that passes through the area of the end portions 63*a* and 66*a* on the sides of the gaps 63 and 66 close to the exhaust port 53 becomes the fastest in the air (E3 and E7) at a time of flowing to pass through the gap 63 of the lowermost stream flow control member 62 and the gap 66 of the middle flow control member 65 due to the suction force of the suction machine 50 in the longitudinal direction B of the suction port 52, and the speed of the air (E3*b* and E3*c*) passing through the respective areas gradually separated from the end portions 63*a* and 66*a* of the gaps 63 and 66 is subjected to being gradually slowed due to the separation. In other words, in the longitudinal direction B of the suction port 52, the speed of air (E8*a*) passing through the area of the end portion 52*a* on the side of the suction port 52 close to the exhaust port 53 becomes the fastest, and the speed of air (E8*b*, E8*c*, and E8*d*) passing through the respective areas gradually separated from the end portion 52*a* of the suction port 52 becomes gradually slowed (refer to FIGS. 7A and 7B). Still, the wind speed difference of the air (E8) in the longitudinal direction B of the suction port 52 in this case is a difference causing no practical problem.

The air (E8) suctioned from the suction port 52 of the suction duct 51B as described above passes through the plural ventilation portions 71 of the permeable member 70 of the uppermost stream flow control member 61 to be suctioned with the traveling direction thereof aligned in the direction substantially orthogonal to the longitudinal direction B of the suction port 52, and the air suction velocity in the longitudinal direction B of the suction port 52 is controlled not to be considerably different. In addition, the wind speed of the air (E8) suctioned from the suction port 52 is controlled not to be considerably different in the longitudinal direction B of the opening shape (oblong shape) of the suction port 52 and is controlled not to be considerably different in the lateral direction C (refer to FIG. 10 the like) substantially orthogonal to the longitudinal direction B.

The flow of the air (E8) that is suctioned from the suction port 52 into the flow path space 54*a* of the second bent flow path 54E is in a state of being controlled by the middle flow control member 65, and thus stays in a temporarily circulating state in the flow path space 54*a* of the second bent flow path 54E. In this manner, the air (E8) that is suctioned with the speed difference in the longitudinal direction B (and the lateral direction C) of the suction port 52 is mixed due to the temporary circulating stay and, as a result, the speed difference is alleviated and is cancelled to some extent.

The suction force of the air (E8) in the suction port 52 of the suction duct 51B is exerted also in the shield case 16*a* of the charge adjusting corona discharger 16 and the opening 16*b* thereof via the connection duct 56. In this manner, the air that is present in the shield case 16*a* of the charge adjusting corona discharger 16 and the air that is present in the vicinity of the opening 16*b* are suctioned from the suction port 52 of the suction duct 51.

In this case, the suction of the air in the suction port 52 of the suction duct 51B is allowed such that the suction of the air with little unevenness in the longitudinal direction B of the suction port 52 since the air suction velocity in the longitudinal direction B of the suction port 52 is controlled not to be considerably different, and thus the air (E5) that is present in the shield case 16*a* of the charge adjusting corona discharger 16 and the like is also suctioned in the suction duct 51 at the substantially same speed in the longitudinal direction B of the shield case 16*a*.

According to the suction duct 51B, during the operation of the charge adjusting corona discharger 16, the ozone and the corona products that are generated in and in the vicinity of the shield case 16*a* are suctioned substantially uniformly along with the air (E8) in the longitudinal direction B of the shield case 16*a*. Accordingly, in the imaging units 10 (Y, M, C, and K) in which the suction device 5(B) is installed, the generation of defects of the image quality such as concentration unevenness due to, for example, the suction of the air by the suction device performed extremely leaned in the axial direction of the photoconductive drum 11, which causes the ozone and the corona products that are generated in the charge adjusting corona discharger 16 adhere and accumulate in a state of being leaned in the axial direction of the image holding surface of the photoconductive drum 11 corresponding to the side where the suction of the air by the suction device is relatively weak, may be controlled.

(Third Embodiment)

FIGS. 2B, 3B and 4B are views illustrating a suction wind device according to a third embodiment, which illustrate a suction duct 251 of the suction device (205).

As illustrated in FIGS. 3B, 4B, 15, 16 and 17 and the like, a suction duct 251 of this embodiment is shaped to have a suction port 252 that is arranged in a state of substantially facing a part of (opening 216*d* of a back surface plate of a shield case 216*a*) of a charge adjusting corona discharger 216, which is an object of air suctioning, in a longitudinal direction $B_2$, and suctions air, an exhaust port 253 that is connected to a suction machine 250, and discharges the air which is suctioned from the suction port 252, and a flow path (main body portion) 254 where a flow path space 254*a*, which connects the suction port 252 to the exhaust port 253, is formed to cause the air to flow. The suction device 205 according to the third embodiment is arranged in a state where the suction port 252 of the suction duct 251 covers the outer surface on the back side of the shield case 216*a* of the charge adjusting corona discharger 216. As such, the suction port 252 is in a state of being connected to the opening 216*d* of the back surface plate of the shield case 216*a* (refer to FIG. 2B, and 18).

As illustrated in FIGS. 3B, 4B, and the like, a flow path 254 of the suction duct 251 is configured from a suction flow path 254B, and a bent flow path 254A that continues with the flow path space being bent in a desired direction from the suction flow path 254B.

One end portion of the suction flow path 254B is open with the suction port 252 disposed, and the other end portion thereof is connected to a part of a flow path space 254*ab* of the bent flow path 254A. The suction flow path 254B is a horizontally long square tube-shaped flow path in terms of the overall appearance of the flow path, which is formed to extend in the longitudinal direction $B_2$ (direction substantially parallel to a coordinate axis Z) of the charge adjusting corona discharger 216 and is also formed to extend in a direction (direction substantially parallel to a coordinate axis X) away from the opening 216*d* of the charge adjusting corona discharger 216. A flow path space 254*aa* of the suction flow path 254B is also formed to have a horizontally long square tube shape substantially similarly to the overall appearance of the flow path. In addition, the bent flow path 254A is formed to extend in one direction of the longitudinal direction $B_2$ of the charge adjusting corona discharger 216 after being connected to the other end portion of the suction flow path 254B, and is a square tube-shaped flow path in terms of the overall appearance of the flow path with one end portion thereof closed and the terminal end portion open as the exhaust port 253. The exhaust port 253 is present in the terminal end portion of the bent flow path 254A, and thus can be referred to as an exhaust flow path. The flow path space 254*ab* of the bent flow path (exhaust flow path) 254A is also formed to have a square tube shape substantially similarly to the overall appearance of the flow path.

The opening shape of the suction port 252 is a rectangular shape in the suction duct 251 according to the third embodiment while the opening shape of the exhaust port 253 is a substantially square shape. Since the shapes are different from each other, a bent part (connection part between the ventilation flow path 254B and the bent flow path 254A in actuality) is present in the (flow path space 254*a* of the) flow path 254. As a result, in the suction duct 251, the cross-sectional shape of the flow path space 254*aa* in the suction flow path 254B in particular is a rectangular shape widening only in a substantially horizontal direction while the cross-sectional shape of the flow path space 254*ab* in the bent flow path 254A is changed into a substantially square shape (with the height not changed). In other words, the cross-sectional shape of the flow path space 254*ab* of the bent flow path 254A is a cross-sectional shape that is rapidly narrowed in a substantially horizontal direction (direction substantially parallel to the coordinate axis X or Z) with respect to the flow path space 254*aa* of the suction flow path 254B.

As illustrated in FIGS. 3B, 4B, 15, 16, 17 and the like, the flow path 254, where the flow path space 254*a* that connects the suction port 252 to the exhaust port 253 and causes the air to flow is formed in a bent shape in at least one place (one place in this example), and a flow control member 261 that suppresses the flow of the air to the flow path space 254*a* of the flow path 254 are disposed in the suction duct 251 of the suction device 205 according to the third embodiment.

The flow control member 261 is disposed in the flow path space 254*aa* of the ventilation flow path 254B that is a part on a more upstream side than a part where the flow path space is bent between the ventilation flow path 254B and the bent flow path 254A of the flow path 254. Adopted as the flow control member 261 is what is shaped such that blocks a desired position of the suction flow path 254B with an elongated ventilation portion 263 present to cross a part of the flow path space 254*aa* in the suction flow path 254B in a direction (crossing direction) parallel to the longitudinal direction $B_2$ of the suction port 252.

Figure 15:
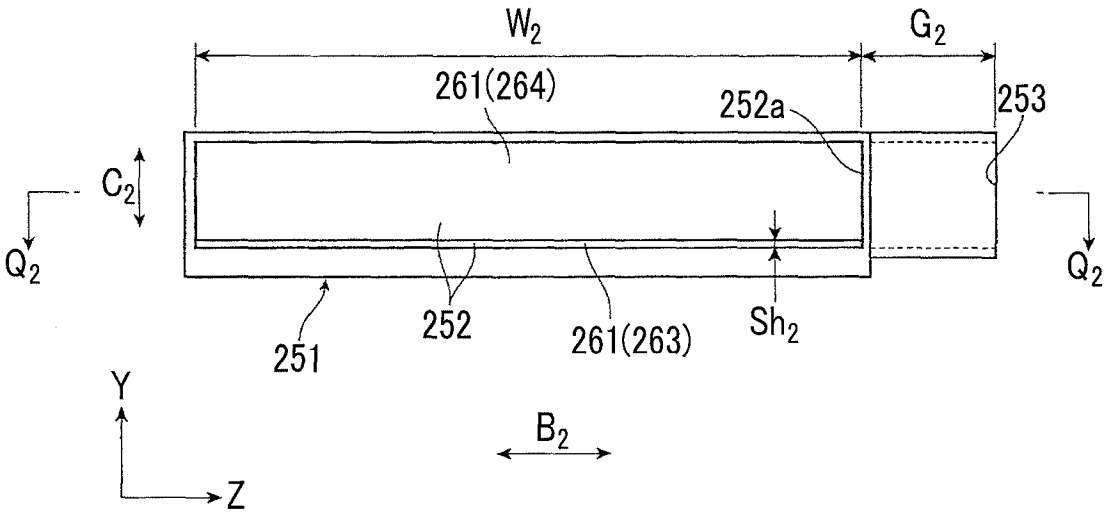
FIG. 15 is a schematic view illustrating the suction duct of the suction device when viewed from the suction port side.

The flow control member 261 of the third embodiment is configured by arranging a plate-shaped blocking member 264 in the flow path space 254*aa* of the flow path 254B in a state of crossing at a constant gap with respect to one side surface 254*b* of the cross-sectional shape of the flow path space 254*aa* without changing the appearance of the suction flow path 254B. In detail, as illustrated in FIGS. 15, 16, and the like, the blocking member 264 is a flat plate with a thickness $Sm_2$ formed of the length (width) which is equal to the width $W_2$ of the suction port 252, blocks the flow path space 254*aa* in a state of crossing in the crossing direction (direction parallel to the longitudinal direction $B_2$) at a position recessed inside by the distance $D_2$ from the suction port 252 of the suction flow path 254B, and is arranged in a state where a desired gap $Sh_2$ is present between one end portion (lower end portion on the long side) 264*a* of the blocking member and one inner wall surface 264*a* of the flow path space 254*aa* with a continuous gap is allowed to be present.

In the flow control member 261, a band-shaped and continuously present gap (penetrating portion) between the (one end portion 264*a* of the) blocking member 264 and one inner wall surface 254*b* (lower surface portion of the flow path space 254*aa*) of the flow path space 254*a* is the ventilation portion 263 with an elongated shape. In addition, as illustrated in FIGS. 16, and 17, the flow control member 261 is arranged to be present at a position shifted by a predetermined distance $N_2$ to a side close to the suction port 252 on the basis of the position of the longitudinal direction $B_2$ passing through the end portion 253*a* of the exhaust port 253 on a side close to the suction port 252.

Figure 16:
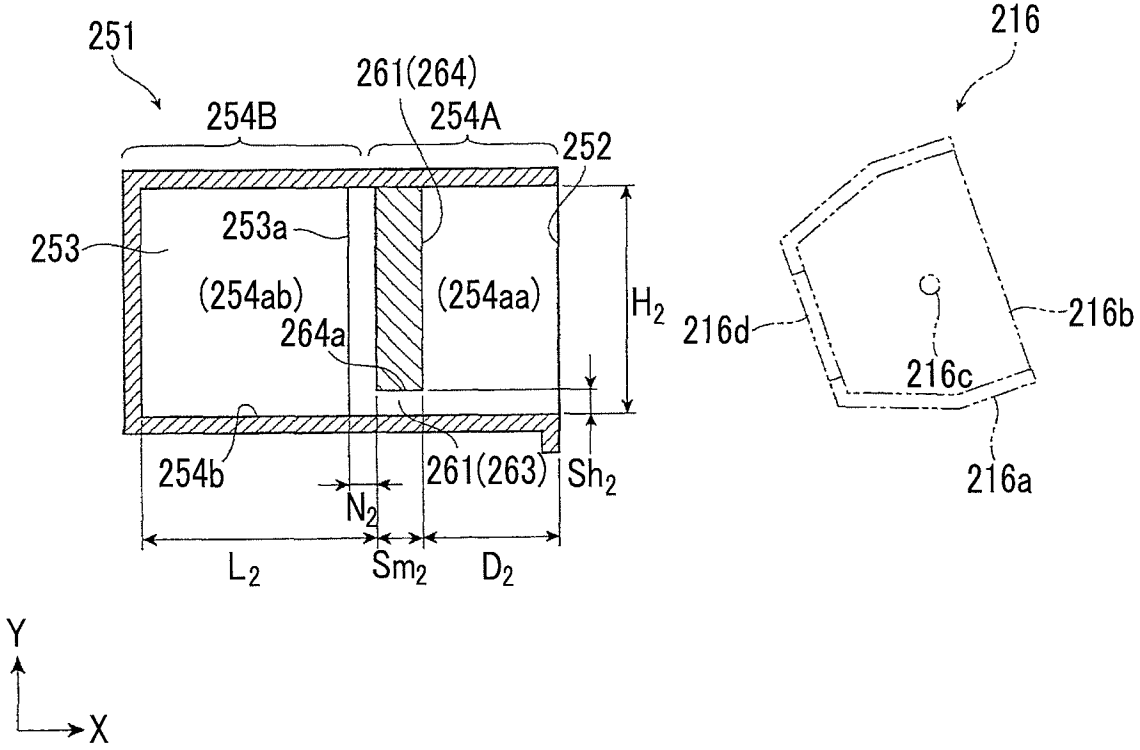
FIG. 16 is a cross-sectional explanatory view of the suction device (suction duct) and the corona discharger of FIGS. 3A and 3B taken along line Q-Q.
Figure 17:
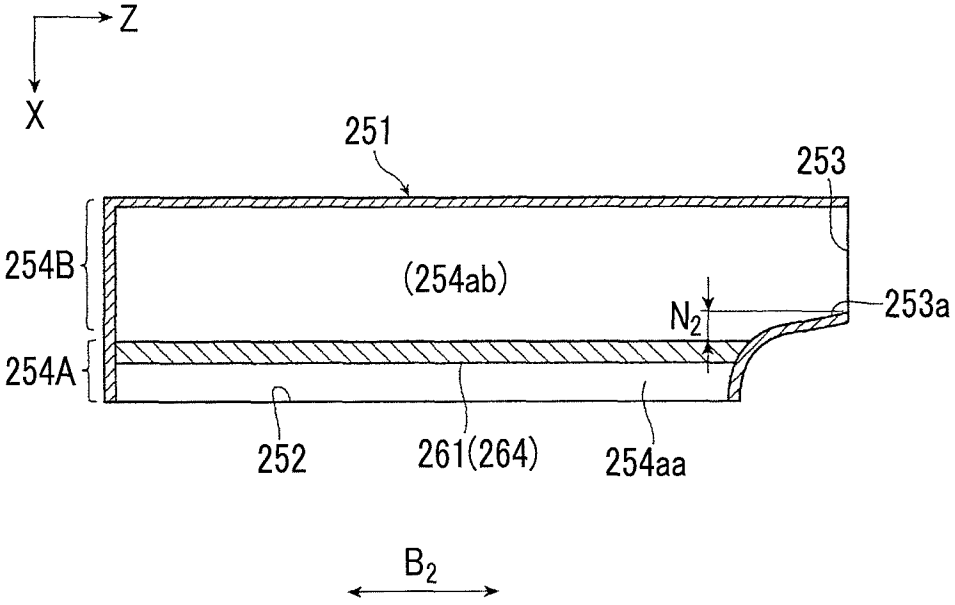
FIG. 17 is a cross-sectional schematic view illustrating a configuration of the suction duct along Q-Q line of FIG. 5.

In the flow control member 261, the height $Sh_2$ of the ventilation portion 263 (penetrating portion), the path length $Sm_2$, and the installation initiation position (distance $D_2$ recessed inside from the suction port 252) illustrated in FIG. 16 and the like are selectively set from the point of view of being capable of causing the wind speed of the air flowing from the suction flow path 254B into the bent flow path 254A to be as uniform as possible. In addition, these values are set in view of the dimension (capacity) of the suction duct 251 and the amount of the air suctioned by the suction duct 251 or the flow per unit time of the air that should be suctioned from the charge adjusting corona discharger 216. Sign $H_2$ illustrated in FIG. 16 illustrates the height dimension of the flow path space 254*aa* of the ventilation flow path 254B (which is also the height dimension of the suction port 252 in this example). In addition, likewise, sign $L_2$ illustrates the length dimension of the flow path space 254*ab* part that is present on a downstream side in a direction in which the air flows from the (blocking member 264 of the) flow control member 261.

Hereinafter, the operation of the suction device 205 will be descried.

The suction device 205 suctions a desired wind amount of the air with the suction machine 250 being driven to rotate first in a driving setting period such as during an image forming operation. When the suction machine 250 starts, the operation for suctioning and discharging the air (E200) is initiated in the suction machine 250 as illustrated in FIG. 7B, and the suctioning force of the air which is generated by the operation of the suction machine 250 reaches the suction duct 251 through a connection duct 255. In this manner, in the suction duct 251, the suctioning of the air (E200) is initiated in the suction port 252.

In this case, the air (E202) that is present in the flow path space 254*ab* of the bent flow path 254A of the suction duct 251 is suctioned out from the exhaust port 253 first due to the suctioning force of the suction machine 250. In this manner, the air (E202) that is present in the flow path space 254*ab* of the bent flow path 254A flows substantially in an air flowing direction R201 in the flow path space 254*ab*, and ultimately passes through the exhaust port 253 as the collected discharge air (E201) right in front of the exhaust port 253 and flows out toward the connection duct 255. When the air is suctioned out from the exhaust port 253 in this manner, the suctioning force of the suction machine 250 is exerted in the flow path space 254*ab* of the bent flow path 254A.

Figure 18:
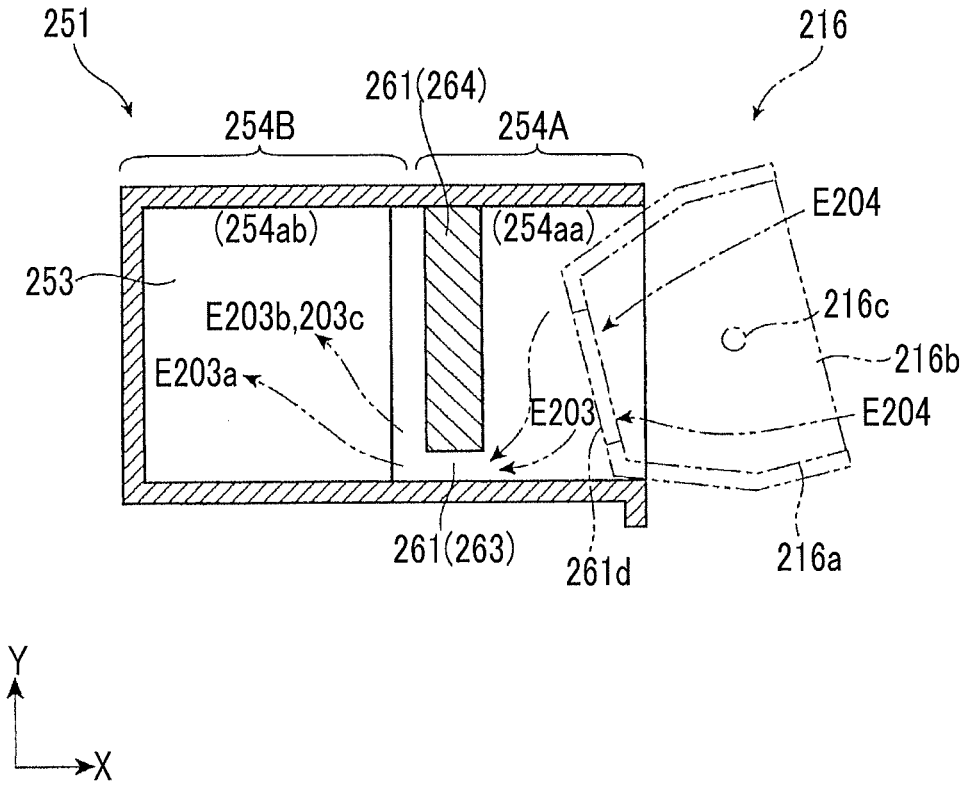
FIG. 18 is a schematic explanatory view illustrating a state where the air flow direction and state in the suction duct of FIGS. 3A and 3B are viewed in the cross-sectional state illustrated in FIG. 5.

Next, the air (E203) that is present in the flow path space 254*aa* of the suction flow path 254B is moved to be suctioned in the flow path space 254*ab* of the bent flow path 254A due to the suctioning force of the suction machine 250 exerted in the flow path space 254*ab* of the bent flow path 254A. As illustrated in FIGS. 7B and 18, the air (3203) in this case passes through the ventilation portion 263 in the flow control member 261 in the flow path space 254*aa* of the suction flow path 254B and flows into the flow path space 254*ab* of the bent flow path 254A.

In this case, the air (E203) that is present in the flow path space 254*aa* of the suction flow path 254B flows in an air flowing direction R202 in the flow path space 254*aa*. However, the progress of the air (E203) is blocked by the blocking member 264 in the flow control member 261, and thus is put into a state of being capable of passing little by little through the elongated ventilation portion 263 in the flow control member 261, is put into a state of being suppressed in entirety (state where the pressure is increased), passes through the gap (penetrating portion) of the ventilation portion 263, and flows into the flow path space 254*ab* of the bent flow path 254A.

In this manner, the air (3203) that is suctioned and flows from the suction flow path 254B to the bent flow path 254A is, in general, tends to flow as the air (E203*a*) in a state of being concentrated and sided in an end portion area on a side of the suction flow path 254B close to the exhaust port 253 (suction machine 250 in reality) as illustrated in FIG. 7B. However, in this suction duct 251, the uppermost stream flow control member 261 is disposed, and thus the air (E203*b* and E203*c*) that is not only sided in an area of the end portion 254Bc on a side of the suction flow path 254B close to the exhaust port 253 but also passes through the area reaching the end portion 254Bd on the side opposite to the area of the 254Bc increases. In the case of a suction duct where the flow control member 261 is not disposed, the air (E203) that flows from the suction flow path 254B to the bent flow path 254A almost passes through the area of the end portion (254Bc) on a side of the suction flow path 254B close to the exhaust port 253 and flows massively as the air (E203*a*) in a state of being extremely sided on one end side in entirety (refer to FIG. 23. The left end in the drawing corresponds to the end portion 254Bc on a side of the suction flow path 254B close to the exhaust port 253).

As a result, the air (E203) does not pass in a state of relatively largely sided in the vicinity of the end portion 263*a* on a side of the longitudinal direction $B_2$ of the ventilation portion 263 of the flow control member 261 close to the exhaust port 253 and passes in a substantially identical state (state of being substantially uniform with no unevenness) over the substantially entire area of the ventilation portion 263 in the longitudinal direction $B_2$. In addition, since the air (E203) at least passes the ventilation portion 263 in the flow control member 261, the suctioning force of the suction machine 250 can also be exerted with respect to the flow path space 254*aa* of the suction flow path 254B on the upstream side of the air flowing direction R202 from the flow control member 261.

Lastly, the air (3204) that is present out of the suction port 252 is suctioned into the flow path space 254*aa* of the suction flow path 254B through the suction port 252 due to the suctioning force of the suction machine 250 exerted in the flow path space 254*aa* of the suction flow path 254B. In this case, the air (E204) is the air that is present in and in the vicinity of the shield case 216*a* of the charge adjusting corona discharger 216 in reality. When the air (E204) is suctioned into the passing space 254*aa* of the ventilation flow path 254B from the suction port 252, the suctioning force of the suction machine 250 is exerted out of the suction port 252.

In this case, the air (E204) that is suctioned from the suction port 252 becomes the air (E203) that is present by being moved into the flow path space 254*aa* of the suction flow path 254B, and then passes the ventilation portion 263 in the flow control member 261 in a substantially identical state over the substantially entire area in the longitudinal direction as described above, and thus is suctioned in a uniform state from an area space substantially close to the opening shape of the suction port 252.

Strictly, in the longitudinal direction $B_2$ of the suction port 252, the speed of the air (E203*a*) that passes through the end portion 263*a* area on a side of the ventilation portion 263 close to the exhaust port 253 is the highest as illustrated in the example of FIG. 7B in the air (E203) at a time of flowing through the ventilation portion 263 of the uppermost stream flow control member 261 due to the suctioning force of the suction machine 250 and the speed of the air (for example, E203*b* and E203*c*) that pass through the respective areas gradually away from the end portion 263*a* of the ventilation portion 263 is affected to gradually decrease as the away distance increases. In other words, in the longitudinal direction $B_2$ of the suction port 252, the speed of the air (E204*a*) that passes through the end portion 252*a* area of the suction port 252 on a side close to the exhaust port 253 is the highest and the speed of the air (for example, E204*b*, E204*c* and E204*d*) that pass through the respective areas gradually away from the end portion 252*a* of the suction port 252 is affected to gradually decrease as the away distance increases. However, the speed (wind speed) difference at the respective points in the longitudinal direction $B_2$ of the suction port 252 in the air (E204) in this case is so small that poses no practical problem (refer to FIG. 20).

As described above, the air (E204) that is suctioned from the suction port 252 of the suction duct 251 passes through the elongated ventilation portion 263 in the uppermost stream flow control member 261, is suctioned such that the traveling direction thereof flows aligned in a direction substantially orthogonal to the longitudinal direction $B_2$ of the suction port 252, and is put into a state where a substantial change in the speed of suctioning of the air in the longitudinal direction $B_2$ of the suction port 252 is suppressed so that the speed is substantially uniform. In addition, a substantial change in the wind speed of the air (E204) that is suctioned from the suction port 252 is in a state of being suppressed in the longitudinal direction $B_2$ of the opening shape (rectangular shape) of the suction port 252, and a substantial change in a short direction $C_2$ (FIG. 15 and the like) that is substantially orthogonal to the longitudinal direction $B_2$ is also in a state of being suppressed.

The suctioning force of the air (E204) in the suction port 252 of the suction duct 251 is also exerted in the shield case 216*a* of the charge adjusting corona discharger 216 and the opening 216*b* thereof as well. In this manner, the air that is present in the shield case 216*a* of the charge adjusting corona discharger 216 and the air that is present in the vicinity of the opening 216 are suctioned from the suction port 252 of the suction duct 251.

The suctioning of the air in the suction port 252 of the suction duct 251 in this case allows the suctioning of the air in a state of being uniform with little unevenness in the longitudinal direction $B_2$ with a substantial change in the speed of suctioning of the air in the longitudinal direction $B_2$ of the suction port 252 suppressed, and the air (E204) that is present in the shield case 216*a* of the charge adjusting corona discharger 216 and the like is also suctioned into the (suction port 252 of the) suction duct 251 at a speed that is substantially identical to that in the longitudinal direction $B_2$ of the shield case 216*a* thereof.

In this manner, the ozone and the corona products that are generated in and in the vicinity of the shield case 216*a* during the operation of the charge adjusting corona discharger 216 are suctioned substantially uniformly along with the air (E204) by the suction port 252 of the suction duct 251 in the longitudinal direction $B_2$ of the shield case 216*a*. Accordingly, with an imaging unit 10 (Y, M, C, and K) where the suction device 205 is installed, the following inconvenience that occurs in a case where the suctioning of the air by the suction device 205 for example is performed extremely sided in an axial direction of the photoconductive drum 211 can be reduced. In other words, in a case where the suctioning of the air of the suction device 205 is performed extremely sided, the ozone and the corona products generated in the charge adjusting corona discharger 216 are adhered and deposited in a sided state in a part of the image holding surface of the photoconductive drum 211 in the axial direction corresponding to the site where the suctioning of the air by the suction device 205 is relatively weak, which results in the occurrence of poor image quality such as uneven concentration. However, the inconvenience described above can be reduced.

<Test A Relating to Suction Duct>

Test A is a simulation of the wind speed of the air passing through the front part of the ventilation portion 263 of the flow control member 261 in each of test examples (test No. 1 to 20) after the conditions of the flow control member 261 in the suction duct 251 having the following basic configuration are set to the respective values illustrated in FIG. 19.

The simulation of Test A is performed on an assumption that the suction duct 251 has the overall shape illustrated in FIGS. 3B, 4B, 15, 16, and the like and the following conditions.

The suction duct 251 with the suction port 252 having a height of 22 mm and a width $W_2$ of 350 mm with a rectangular opening shape and the discharge port 253 having a height of 22 mm and a width $L_2$ of 18 mm with a substantially square opening shape is used (FIG. 3B, 15, 16, and the like). In addition, both of the height $H_2$ of the flow path space 254*aa* of the ventilation flow path 254B in the suction duct 251 and the height of the flow path space 254*ab* of the bent flow path 254A are 22 mm.

According to the object flow control member 261, the distance $D_2$ recessed inside from the suction port 252 is 11 mm, and the path length $Sm_2$ and the height $Sh_2$ of the gap constituting the ventilation portion 263 at a position shifted by a distance $N_2$ of 4 mm to 6 mm from the one end portion 253*a* of the exhaust port 253 on the upstream side in the air flowing direction R202 of the ventilation flow path 254B are configured by using the respective values illustrated in FIG. 19 (FIGS. 16, and 17). The width $W_2$ of the gaps constituting the ventilation portion 263 are configured to be 350 mm alike. In addition, the length dimension $L_2$ of the flow path space 254*ab* part that is present on the downstream side in the air flowing direction R202 from the (blocking member 264 of the) uppermost stream flow control member 261 in the suction duct 251 is 23 mm to 25 mm.

In addition, the simulation of Test A assumes a case where each suctioning is performed by the suction machine 250 such that the wind volume at a time of suctioning of the air suctioned out from the exhaust port 253 of the suction duct 251 are the two types of values (low wind volume and high wind volume) illustrated in FIG. 19, and the wind speed of the air at the front side position of the flow control member 261 at a time of the respective suctioning at the wind volume (low wind volume and high wind volume) during the respective suctioning is calculated. The front side position of the flow control member 261 is a position of the middle of the respective height $Sh_2$ of the ventilation portion 263 at the intermediate position between the flow control member 261 and the suction port 252. The simulation is what is analyzed (number of iterations of 1,000 times) by using thermal fluid analysis software. In addition, in this simulation, a physics model of "k-ωSST model (valuing the speed realm in the vicinity of the wall surface)", and a wall surface model of "Hybrid Wall Function (0.1<Y+<100)" is applied.

Figure 20:
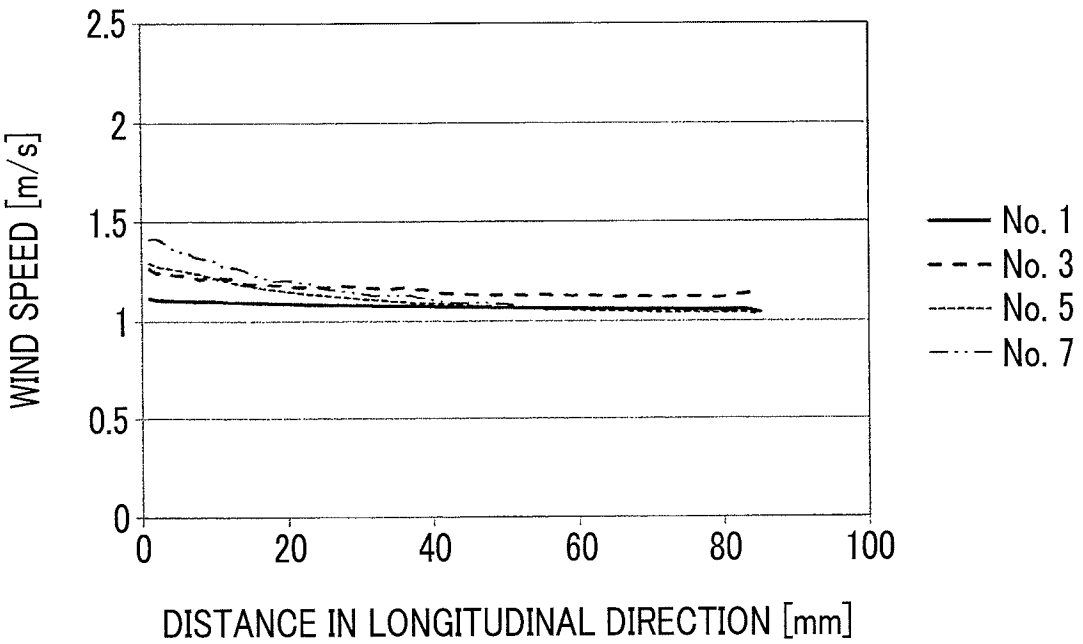
FIG. 20 is a graph illustrating a result of simulation at the time of suction of sample A with a low wind volume (wind speed distribution of suction in the longitudinal direction of the suction port)
Figure 21:
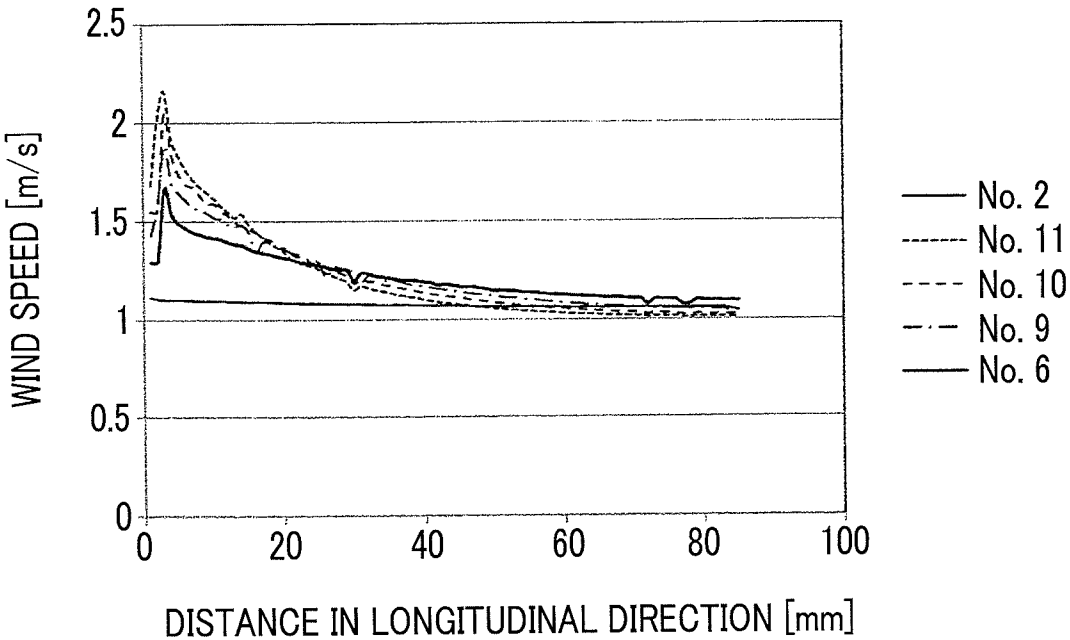
FIG. 21 is a graph illustrating a result of simulation at the time of suction of sample A with a high wind volume (wind speed distribution of suction in the longitudinal direction of the suction port)

FIGS. 20 and 21 illustrate the result of the simulation of this test. FIG. 20 represents Test No. 1, 3, 5, and 7, when the wind volume during the suctioning is the low high air volume (0.1 $m^3$/min). FIG. 21 represents Test No. 2, 6, 9, 10, and 11, when the wind volume during the suctioning is a high wind volume (0.3 $m^3$/min). As for the horizontal axis in FIGS. 20 and 21, for example, the position "0" in the longitudinal direction illustrates the position corresponding to "0 mm" in the distance in the longitudinal direction $B_2$, and the position "85" in the longitudinal direction illustrates the position corresponding to "350 mm" in the distance in the longitudinal direction $B_2$.

Apparent from the result illustrated in FIG. 20 is that the wind speed of the air suctioned from the suction port 252 is with the unevenness suppressed in the longitudinal direction $B_2$ of the suction port 252. In addition, it is confirmed that the wind speed distribution of the air suctioned from the suction port 252 tends to be substantially the same even in a case where the height $Sh_2$ of the ventilation portion 263 is changed or the path length $Sm_2$ of the ventilation portion 263 is changed in the flow control member 261. Apparent from the result illustrated in FIG. 21 is that the wind speed of the air suctioned from the suction port 252 is with unevenness suppressed in the longitudinal direction $B_2$ of the suction port 252 in Test No. 2 in a case where the wind volume during the suctioning is a high wind volume. In addition, in the case of Test No. 6, 9, and 10, it is known that the wind speed of the air suctioned from the suction port 252 is substantially uniform in entirety, although somewhat high in the end portion area on the exhaust port 253 side in the longitudinal direction $B_2$ of the suction port 252, without substantially being affected by the difference of the height $Sh_2$ in the ventilation portion 263 of the flow control member 261. Referring to the result illustrated in FIG. 21, the speed (wind speed) of the air at a time of passing through the ventilation portion 263 tends to increase since the air is unlikely to flow in the ventilation portion 263 as the path length $Sm_2$ of the ventilation portion 263 increases and the height $Sh_2$ of the ventilation portion 263 decreases.

Apparent from the result illustrated in FIG. 21 is that the difference between the highest wind speed and the lowest wind speed in the longitudinal direction $B_2$ of the suction port 252 is a value exceeding 1 m/s in the case of Test No. 11 (In other words, when the height $Sh_2$ of the ventilation portion 263 is 6 mm). In other words, it is known that it is difficult to suppress the unevenness of the suctioning state (wind speed) in the longitudinal direction of the suction port 252. According to the tests by the present inventors, it has been confirmed that the result with the wind speed unevenness having a similar tendency as in the result of Test No. 11 is present even in a case where Test A is performed with the height $Sh_2$ of the ventilation portion 263 with a large value of at least 5 mm (for example, including Test No. 10). Accordingly, in a case where the height $Sh_2$ of the ventilation portion 263 is on the basis of the height $H_2$ (22 mm in the test) of the flow path space 254*aa* of the suction flow path 254B, it can be said that the unevenness of the suctioning state (wind speed) is unlikely to be suppressed in the longitudinal direction of the suction port 252 when the height $Sh_2$ of the ventilation portion 263 is a value of at least 6 mm with respect to the height $H_2$ (22 mm) of the flow path space 254*aa* of the suction flow path 254B, that is, a value exceeding ⅕ (≅5/22)

Accordingly, in the suction duct 251, it can be said from the result of Test A that the unevenness of the suctioning state (wind speed) can be suppressed in the longitudinal direction of the suction port 252 when the height $Sh_2$ of the ventilation portion 263 of the flow control member 261 is a value less than 5 mm with respect to the height $H_2$ (22 mm) of the flow path space 254*aa* of the suction flow path 254B, furthermore, a value of equal to or less than ⅕ (≅5/22)

<Test B Relating to Suction Duct>

Figure 22A:
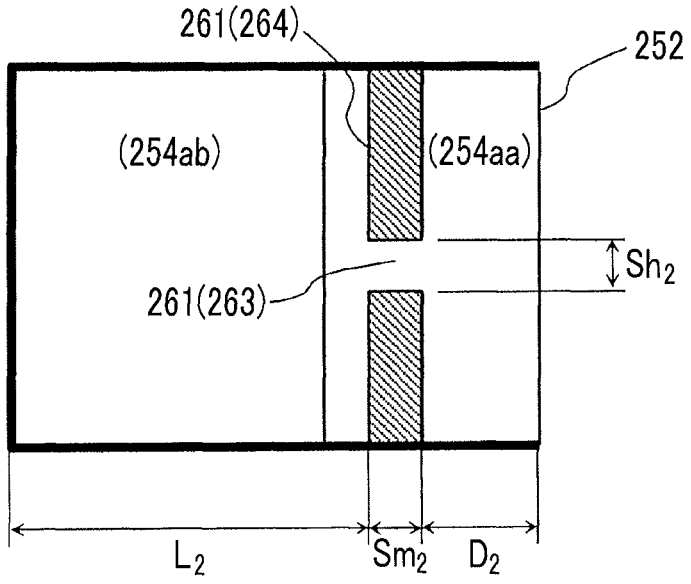
FIGS. 22A and 22B are conceptional views illustrating a configuration example of the suction duct used in sample B relating to the suction duct.
Figure 22B:
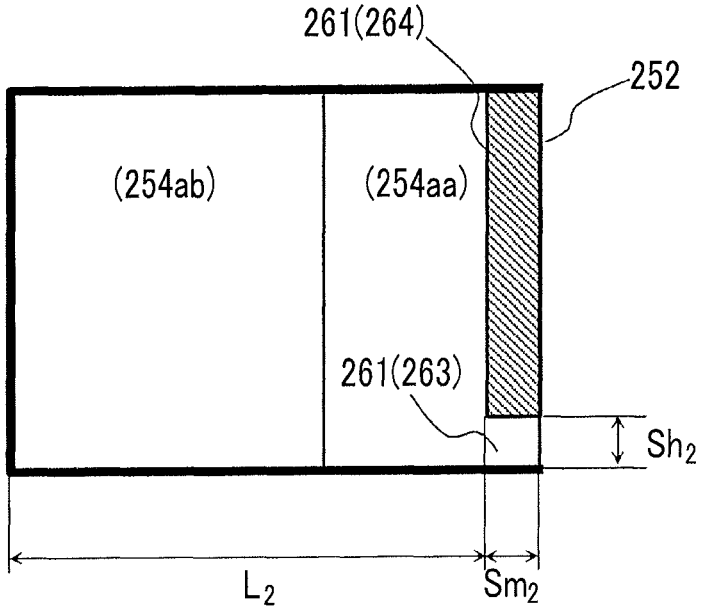

Test B is a simulation of the wind speed in the longitudinal direction $B_2$ of the suction port 252 of each of the suction ducts 251 after the three following types are used as the suction duct 251. One of the suction ducts 251 is a suction duct having the configuration used in No. 1 of Test A described above (the ventilation portion 263 of the flow control member 261 being present below the flow path space 254*aa*). The second suction duct 251 (Test No. 15) is formed from the same basic configuration as the basic configuration (excluding the position of the ventilation portion 263) of the suction duct used in No. 1 of the Test A described above, and the ventilation portion 263 of the flow control member 261 is present in the middle in the height direction of the flow path space 254*aa* as illustrated in FIG. 22A. The third suction duct 251 (Test No. 16) is formed from the same basic configuration as the basic configuration (excluding the arrangement condition of the flow control member 261) of the suction duct used in No. 1 of the Test A described above, and the flow control member 261 is disposed in a state ($D_2$=0 mm) of being sided to the suction port 252 as illustrated in FIG. 22B. The simulation in this case is performed at the same setting content (content in which the wind volume at a time of ventilation is a low wind volume) as in Test A.

Figure 23:
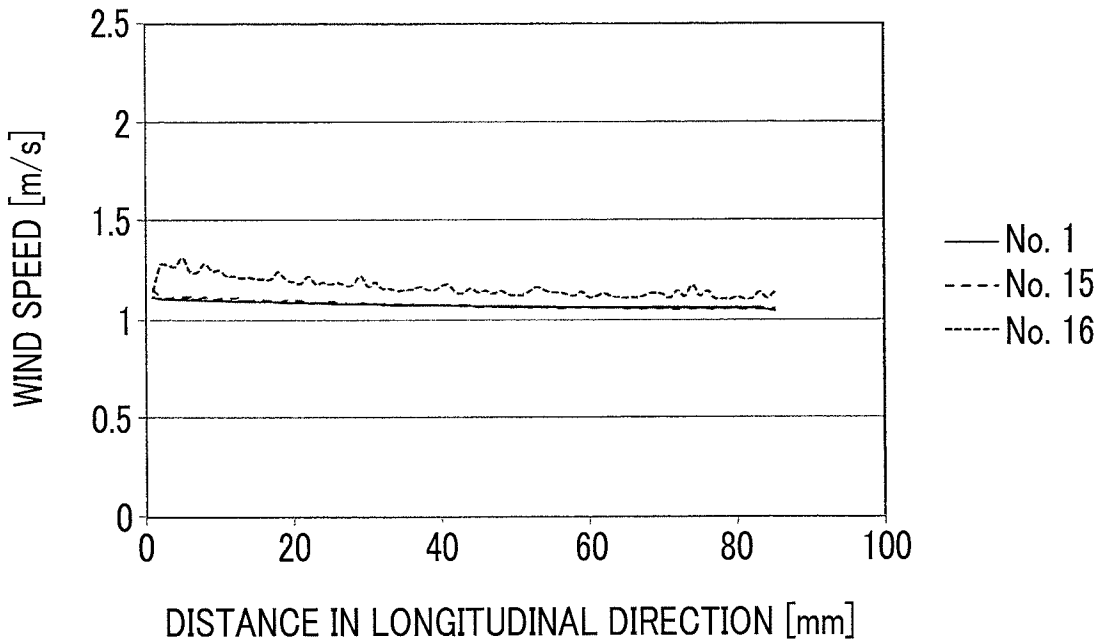
FIG. 23 is a graph illustrating a result of simulation of sample B (wind speed distribution of suction in the longitudinal direction of the suction port).

The result in this case is illustrated in FIG. 23.

Apparent from the result illustrated in FIG. 23 is that the speed (wind speed) of the suctioning of the air in the longitudinal direction $B_2$ of the suction port 252 is uniform and the unevenness in the wind speed is suppressed in a case (Test No. 15. FIG. 22A) where the suction duct 251 is used in which the ventilation portion 263 of the flow control member 261 is arranged at a position in the middle in the height direction of the ventilation space 254*aa*, which is substantially similar to the result of a case (Test No. 1) where the suction duct 251 is used in which the ventilation portion 263 is arranged at a position below in the height direction of the ventilation space 254*aa*.

Strictly, a slight unevenness in the speed (wind speed) of suctioning of the air in the longitudinal direction $B_2$ of the suction port 252 occurs in a case (Test No. 16. FIG. 22B) where the suction duct 251 is used in which the flow control member 261 is disposed in a state of being sided to the suction port 252 when compared to the result of a case (Test No. 1) where the suction duct 251 is used in which the flow control member 261 is disposed in a state of being shifted inside from the suction port 252 to the ventilation space 254*aa*. However, even in a case where the suction duct 251 of the Test No. 16 is used, the speed (wind speed) of suctioning of the air in the longitudinal direction $B_2$ of the suction port 252 is uniform and the suppression of the unevenness of the wind speed is allowed substantially similarly to a case of Test No. 1 in practicality.

For reference, the same simulation of Test B is performed on an assumption of a general suction duct (comparative example) 510X used in a suction device of the related art as illustrated in FIGS. 13A and 13B (the wind volume at a time of ventilation is a high wind volume).

The suction duct 510X has the same shape and basic configuration as the suction duct 251 applied in Test A (B), and is different only in that the uppermost stream flow control member 261 is not disposed in the suction flow path 254B. Sign 520 illustrated in FIGS. 13A and 13B illustrates the suction port and sign 530 illustrates the exhaust port.

FIG. 14 illustrates the result of the simulation according to the comparative example. In the graph of FIG. 14, the position on the horizontal axis illustrated with "0 mm" corresponds to the middle position of the suction port 252 in the longitudinal direction $B_2$. In addition, the minus side (left side in the drawing) on the horizontal axis is an area that is present on the end portion 252*a* side on a side closer to the exhaust port 253 than the middle position in the suction port 252 of the suction duct 251.

Apparent from the result illustrated in FIG. 14 is that, in the suction duct 510X of the related art, the wind speed is extremely higher in an area (left end side on the horizontal axis in FIG. 14) of the end portion 520*a* on a side close to the exhaust port 530 of the suction port 520 than in the other area (area on a side far from the exhaust port 530) of the suction port 520 and the wind speed distribution of the suctioning of the air in the longitudinal direction $B_2$ of the suction port 520 is in a state of being extremely sided to the one end portion side.

In contrast, as is apparent from the result illustrated in FIGS. 20, 21, and 23, the wind speed distribution of the suctioning of the air in the longitudinal direction $B_2$ of the suction port 252 being in a state of sided to the one end portion side is suppressed in the suction duct 251 where the flow control member 261 is disposed as in Test A or B.

(Other Embodiments)

The two flow control members 61 and 62 are disposed in the first exemplary embodiment and the three flow control members 61, 62, and 65 are disposed in the second exemplary embodiment as the flow control members of the suction duct 51. However four or more flow control members may be disposed. Preferably, the flow control members including the lowermost stream flow control member are disposed at a site where the cross-sectional shape of the flow path space 54*a* of the main body portion 54 of any one of the suction ducts 51 changes and a site where the air flow direction in the flow path space 54*a* is changed (immediately after the change or the like).

In the first and second exemplary embodiments, the lowermost stream flow control member 62 is configured by using the permeable member 70 which is formed to have the plural ventilation portions (holes) 71 formed to be dotted substantially uniformly across the entire opening area of the exhaust port 53. However, for example, the lowermost stream flow control member 62 may be configured by using the permeable member 70 which is represented by a porous member (where the plural ventilation portions 71 are through-gaps with irregular shapes) such as a non-woven fabric which is applied to a filter or the like.

In addition, the overall shape of the suction duct 51 is not limited to the shapes illustrated in the first and second exemplary embodiments. The suction duct 51 may, for example, be applied to other shapes, examples of which include the suction duct 510 (510A to 510X) illustrated in FIGS. 12A to 12C.

The object structure to which the suction device 5 (5B) is applied is not limited to the charge adjusting corona discharger 16 illustrated in the first and second exemplary embodiments, but may be other structures (component parts, component equipment, and the like) that requires the suction of the air and have a (object) part that is long in one direction. Examples of the other object structure include a vicinity part among the parts of the developing devices 14 facing the photoconductive drums 11 that is at least one of an upstream side and a downstream side of the photoconductive drums 11 in the rotation direction, a site between the drum cleaning devices 17 of the photoconductive drums 11 and the charging devices 12, and a vicinity part among the parts of the belt cleaning device 26 facing the intermediate image transfer belt 21 that is at least one of an upstream side and a downstream side of the intermediate image transfer belt 21 in the rotation direction. In addition, in the image holding members that are represented by the photoconductive drums 11 and the intermediate image transfer belt 21, the part where the waste materials such as the ozone and the toner may adhere to cause a deterioration in the image quality are the object structure which requires the suction of the air.

In addition, in the image forming apparatus 1, the configuration such as the image forming method is not particularly limited insofar as the image forming apparatus 1 is equipped with the object structure where the suction device 5 (5B) needs to be applied. If necessary, the image forming apparatus may be an image forming apparatus that forms an image formed of a material other than the developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A suction pipe comprising:

a suction port that has an opening shape which is long in one direction parallel to a longitudinal-direction part of an object structure long in one direction, and is arranged to face the longitudinal-direction part of the object structure to suction the air;

an exhaust port that has an opening shape which is different shape from the opening shape of the suction port, and suctions out the air suctioned from the suction port;

a flow path that connects the suction port and the exhaust port and has at least one bended portion which bends an air flow direction, wherein the flow path contains at least a portion of the air flow direction that is parallel to the longitudinal-direction part of the object structure long in one direction;

a plate-shaped blocking flow control member that is disposed at a flow path in a direction parallel to the suction port, controls a flow of the air, and that blocks air from passing and directs air through a gap adjacent to the plate-shaped blocking flow control member: and an uppermost stream flow control member, which is disposed at the site on a most upstream side in the air flow direction of the flow path, the uppermost stream flow control member being a permeable member that has a plurality of ventilation portions, wherein the uppermost stream flow control member contacts, at least at one end, the suction portion, wherein the uppermost stream flow control member is separate from the plate-shaped blocking flow control member, and wherein the plurality of ventilation portions are arranged substantially parallel to each other and extend along the air flow direction.

2. The suction pipe according to claim 1, wherein the plate-shaped blocking flow control member is disposed between the suction port and the bended portion and the gap extends in a direction parallel to the longitudinal direction of the opening shape of the suction port in the path at a part on the upstream side.

3. The suction pipe according to claim 1, wherein the gap of the plate-shaped blocking flow control member has a height value of equal to or less than ⅕ of the height dimension of the flow path space at a part of the upstream side.

4. The suction pipe according to claim 1, wherein the uppermost stream flow control member is disposed at the suction port.

5. The suction pipe according to claim 1, wherein the plate-shaped blocking flow control member is disposed at the site on a further downstream side than the uppermost stream flow control member in the air flow direction of the flow path space of the flow path and is formed with the gap with a shape extending in a direction parallel to a longitudinal direction of the opening shape of the suction port in the flow path space.

6. The suction pipe according to claim 4, wherein the plate-shaped blocking flow control member is disposed at the site on a further downstream side than the uppermost stream flow control member in the air flow direction of the flow path space of the flow path and is formed with the gap with a shape extending in a direction parallel to a longitudinal direction of the opening shape of the suction port in the flow path space.

7. The suction pipe according to claim 5, wherein the plate-shaped blocking flow control member is disposed between the bended portion and the suction port.

8. The suction pipe according to claim 6, wherein the plate-shaped blocking flow control member is disposed between the bended portion and the suction port.

9. A suction device comprising:

a suction machine that suctions air; and a suction pipe that includes an exhaust port which is connected to the suction machine, wherein the suction pipe is the suction pipe according to claim 1.

10. An image forming apparatus comprising the suction device according to claim 9 and the object structure, wherein the object structure is at least one of a corona discharger, a developing device, and an image holding member.

11. An image forming apparatus comprising:

an object structure that requires suction of air; and a suction device that suctions the air which is present in the object structure, wherein the suction device is the suction device according to claim 9.

12. The image forming apparatus according to claim 11, wherein the object structure is at least one of a corona discharger, a developing device, and an image holding member.

* * * * *